US012460870B2

(12) United States Patent
Yamada et al.

(10) Patent No.: US 12,460,870 B2
(45) Date of Patent: Nov. 4, 2025

(54) HEAT EXCHANGER AND HEAT PUMP APPARATUS

(71) Applicant: DAIKIN INDUSTRIES, LTD., Osaka (JP)

(72) Inventors: Kouju Yamada, Osaka (JP); Tomoki Hirokawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 413 days.

(21) Appl. No.: 17/610,018

(22) PCT Filed: May 8, 2020

(86) PCT No.: PCT/JP2020/018728

§ 371 (c)(1),
(2) Date: Nov. 9, 2021

(87) PCT Pub. No.: WO2020/230737

PCT Pub. Date: Nov. 19, 2020

(65) Prior Publication Data

US 2022/0243988 A1 Aug. 4, 2022

(30) Foreign Application Priority Data

May 10, 2019 (JP) ..... 2019-090092

(51) Int. Cl.
*F28F 9/02* (2006.01)
*F28D 7/16* (2006.01)

(52) U.S. Cl.
CPC . *F28D 7/16* (2013.01); *F28F 9/02* (2013.01)

(58) Field of Classification Search
CPC ..... F28D 7/16; F28D 1/05383; F28D 2021/0068; F28F 9/02; F28F 9/0221;
(Continued)

(56) References Cited

U.S. PATENT DOCUMENTS 5,366,007 A * 11/1994 Hutto ..... F28F 9/0224 165/173
2007/0256821 A1* 11/2007 Mashiko ..... F28F 9/0214 29/890.052

(Continued)

FOREIGN PATENT DOCUMENTS

DE 102008036614 A1 * 2/2009 ..... F28D 1/05383
DE 102016106190 A1 * 10/2016 ..... B23P 15/26

(Continued)

OTHER PUBLICATIONS

International Search Report issued in corresponding International Application No. PCT/JP2020/018728 mailed Aug. 4, 2020 (4 pages).

(Continued)

*Primary Examiner* — Harry E Arant

(74) *Attorney, Agent, or Firm* — Osha Bergman Watanabe & Burton LLP

(57) ABSTRACT

A heat exchanger, that connects to a first pipe through which a refrigerant flows, includes: heat transfer tubes extending in a first direction; and a header connected to the heat transfer tubes. The header includes: a first member including a first portion connected to the heat transfer tubes; and a second member disposed between the first pipe and the first portion. The second member includes: a first wall and a second wall that each extend in the first direction; and a coupling portion that couples the first wall to the second wall. The first pipe communicates with each heat transfer tube through a space delimited by the first wall and the second wall.

15 Claims, 17 Drawing Sheets

(58) Field of Classification Search
CPC .. F28F 1/325; F28F 9/16; F28F 9/0224; F28F 9/0246; F25B 41/24; F25B 39/00; F25B 13/00; F25B 49/02; F25B 2600/0251
See application file for complete search history.

(56) References Cited

U.S. PATENT DOCUMENTS

| | | | |
|---|---|---|---|
| 2012/0204595 | A1 | 8/2012 | Tamaki et al. |
| 2016/0195335 | A1 | 7/2016 | Nishiyama et al. |

FOREIGN PATENT DOCUMENTS

| | | | | | |
|---|---|---|---|---|---|
| EP | 2792987 | A1 | | 10/2014 | |
| FR | 2947332 | A1 | * | 12/2010 | ..... F28F 9/0214 |
| JP | 2004044920 | A | | 2/2004 | |
| JP | 2005345043 | A | | 12/2005 | |
| JP | 2007155268 | A | | 6/2007 | |
| JP | 2008089188 | A | * | 4/2008 | |
| JP | 2009014283 | A | | 1/2009 | |
| JP | 2010139088 | A | * | 6/2010 | |
| JP | 201185343 | A | | 4/2011 | |
| JP | 2014052135 | A | | 3/2014 | |
| JP | 2016109381 | A | | 6/2016 | |
| WO | 2006/028148 | A1 | | 3/2006 | |
| WO | 2015/004719 | A1 | | 1/2015 | |
| WO | WO-2019078066 | A1 | * | 4/2019 | ..... F25B 39/00 |
| WO | WO-2020170348 | A1 | * | 8/2020 | |

OTHER PUBLICATIONS

International Preliminary Report on Patentability issued in corresponding International Application No. PCT/JP2020/018728 dated Nov. 16, 2021 (8 pages).
Extended European search report issued in corresponding European Application No. 20806138.2 dated Jan. 3, 2023 (7 pages).

* cited by examiner

HEAT EXCHANGER AND HEAT PUMP APPARATUS

TECHNICAL FIELD

The present disclosure relates to a heat exchanger and a heat pump apparatus.

BACKGROUND

A known refrigerant cycle apparatus such as an air conditioning apparatus includes a heat exchanger including a heat transfer tube through which a refrigerant flows and a header to which the heat transfer tube is connected.

For example, Patent Literature 1 (WO 2015/004719 A1) discloses a heat exchanger including a gas header that includes a plurality of plate-shaped members stacked on top of each other, the plate-shaped members each having an opening.

PATENT LITERATURE

Patent Literature 1: WO 2015/004719 A1

It is necessary to increase the number of plate-shaped members in order to secure a wide space in the header that includes the plurality of plate-shaped members stacked on top of each other, the plate-shaped members each having the opening.

SUMMARY

In one or more embodiments, a heat exchanger including a header enables a reduction in parts count even when a large space is secured in the header, and also provides a heat pump apparatus.

In one or more embodiments, a heat exchanger is connected to a first pipe through which a refrigerant flows. The heat exchanger includes a plurality of heat transfer tubes, and a header connected to the heat transfer tubes. The header includes a first member and a second member. The first member includes a first portion connected to the heat transfer tubes. The second member is disposed between the first pipe and the first portion. The second member includes a first wall, a second wall, and a coupling portion. The first wall and the second wall each extend in a first direction in which the heat transfer tubes extend. The coupling portion couples the first wall to the second wall. The first pipe communicates with each heat transfer tube through a space defined by the first wall and the second wall.

In the heat exchanger, the first and second walls of the second member extend in the first direction in which the heat transfer tubes extend. With this configuration, the second member secures the space defined by the first wall and the second wall.

In one or more embodiments of the heat exchanger, the coupling portion couples an end of the first wall in the first direction to an end of the second wall in the first direction.

It is sufficient for the coupling portion to couple the end of the first wall in the first direction to the end of the second wall in the first direction. For example, the coupling portion may couple the first wall to the second wall on the opposite side to the heat transfer tubes in the first direction.

In the heat exchanger, the coupling portion couples the end of the first wall to the end of the second wall. This configuration therefore secures the space defined by the first wall and the second wall wide with ease.

In one or more embodiments of the heat exchanger, the coupling portion couples a portion of the first wall, the portion being different from two ends of the first wall in the first direction, to a portion of the second wall, the portion being different from two ends of the second wall in the first direction.

The heat exchanger enables strength enhancement to the second member since the coupling portion couples a portion of the first wall in the first direction, the portion being different from two ends of the first wall in the first direction, to a portion of the second wall in the first direction, the portion being different from two ends of the second wall in the first direction.

In one or more embodiments of the heat exchanger, the first portion has a plate (planar) shape.

Preferably, the first member has a plate shape expanding perpendicularly to a direction in which the heat transfer tubes extend.

The heat exchanger suppresses occurrence of a situation in which an unnecessary space is defined around a portion of each heat transfer tube in the header, since the heat transfer tubes are connected to the plate-shaped first portion.

In one or more embodiments of the heat exchanger, the second member includes a first protrusion and a second protrusion. The first protrusion protrudes from the first wall toward the second wall. The first protrusion is located closer to the heat transfer tubes than the coupling portion is. The second protrusion protrudes from the second wall toward the first wall. The second protrusion is located closer to the heat transfer tubes than the coupling portion is. A minimum distance between the first protrusion and the second protrusion is shorter than a maximum width of each heat transfer tube in section.

According to one or more embodiments, the first and second protrusions of the second member define a degree of insertion of the heat transfer tubes into the header.

In one or more embodiments of the heat exchanger, the coupling portion couples a portion of the first wall, the portion being located closer to the first pipe with respect to a center of the first wall in the first direction, to a portion of the second wall, the portion being located closer to the first pipe with respect to a center of the second wall in the first direction. The first protrusion is located closer to the heat transfer tubes with respect to the center of the first wall in the first direction. The second protrusion is located closer to the heat transfer tubes with respect to the center of the second wall in the first direction.

The heat exchanger ensures a wide space defined by the ends of the heat transfer tubes, the coupling portion, the first wall, and the second wall.

A heat exchanger according to one or more embodiments further includes a third member. The third member is disposed so as to face a side, where the second member is disposed, of the first portion of the first member. The first portion has a plurality of first openings into which the heat transfer tubes are inserted. The third member has a plurality of second openings into which the heat transfer tubes are inserted. Each first opening has a portion overlapping the respective second opening as seen in the first direction.

According to one or more embodiments, the heat transfer tubes are fixed with the heat transfer tubes inserted into the first openings in the first portion. Since the first portion overlaps the third member, a thickness of an overlapping portion of the first portion and the third member is secured, which enhances strength. This configuration thus secures the strength of the overlapping portion of the first portion and the third member even in a case where the first portion is formed thin for reducing friction between an outer peripheral face of each heat transfer tube and the corresponding first opening, the friction being caused in inserting the heat transfer tubes into the first openings.

In one or more embodiments of the heat exchanger, each second opening of the third member is larger than the corresponding first opening of the first portion as seen in the first direction. An edge of each second opening of the third member is located outward of an edge of corresponding first opening of the first portion as seen in the first direction.

According to one or more embodiments, in joining the first portion to the third member by brazing, an excessive brazing material is moved to a region in each second opening, the region being located outside the heat transfer tubes. This configuration therefore suppresses occurrence of a situation in which the flow paths in the heat transfer tubes are filled with the brazing material.

A heat exchanger according to one or more embodiments further includes a fourth member to which the first pipe is connected. The first member includes wall surface portions and claws. The wall surface portions respectively extend from two ends of the first portion toward the first pipe respectively along the first wall and the second wall. The claws are disposed on ends of the wall surface portions opposite to the first portion. The claws extend to come close to each other. The claws are in contact with a surface of the fourth member opposite to the first portion.

It should be noted that the two ends of the first portion may be two ends of the first portion as seen in a longitudinal direction of the first portion.

According to one or more embodiments, the fourth member is held by the claws of the first member. The second member is thus surrounded by the first member and the fourth member.

In a case where each of the first member and the fourth member is made of pitting metal, the corrosion resistance around the header is improved.

In one or more embodiments of the heat exchanger, each heat transfer tube is a flat tube. Each flat tube has a flat face.

Preferably, the flat tubes each have such a sectional shape that a width of the first portion in the longitudinal direction is shorter than a width of the first portion in a direction perpendicular to the longitudinal direction.

In one or more embodiments of the heat exchanger, the first pipe is a gas pipe.

It should be noted that the refrigerant flowing through the gas pipe is not limited to a refrigerant in a gas state, but may be a refrigerant in a gas-liquid two-phase state. Such a refrigerant in a gas-liquid two-phase state preferably has a degree of dryness that is not less than 0.8, for example.

The heat exchanger enables pressure resistance strength enhancement to the header connected to a gas pipe, with ease.

In one or more embodiments, a heat pump apparatus includes the heat exchanger according to any of the above-described embodiments.

DETAILED DESCRIPTION

A description will be given of an air conditioning apparatus including a heat exchanger in accordance with one or more embodiments.

(1) Configuration of Air Conditioning Apparatus

A description will be given of an air conditioning apparatus 1 with reference to the drawings.

Figure 1:
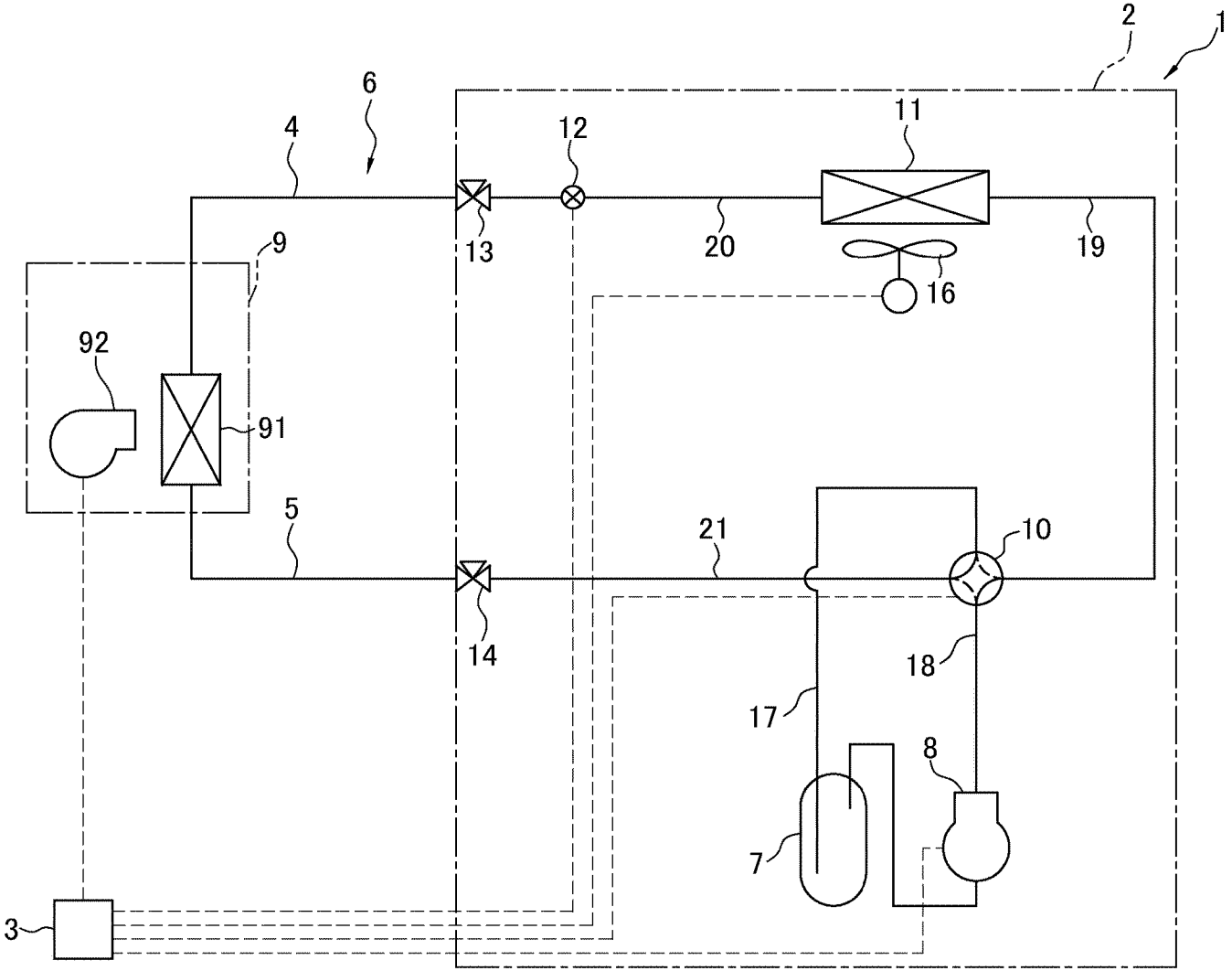
FIG. 1 is a schematic configuration diagram of an air conditioning apparatus.

FIG. 1 is a schematic configuration diagram of the air conditioning apparatus 1 including an outdoor heat exchanger 11 corresponding to a heat exchanger according to one or more embodiments of the present disclosure.

The air conditioning apparatus 1 (which is an example of a heat pump apparatus) is configured to perform a vapor compression refrigeration cycle, thereby cooling and heating an air conditioning target space. Examples of the air conditioning target space may include, but not limited to, spaces in buildings such as an office building, a commercial facility, and a residence. It should be noted that the air conditioning apparatus is merely an example of a refrigerant cycle apparatus. The heat exchanger according to one or more embodiments of the present disclosure may be used for other refrigerant cycle apparatuses such as a refrigerator, a freezer, a water heater, and an underfloor heating apparatus.

As illustrated in FIG. 1, the air conditioning apparatus 1 mainly includes an outdoor unit 2, an indoor unit 9, a liquid-refrigerant connection pipe 4, a gas-refrigerant connection pipe 5, and a control unit 3 configured to control components of the outdoor unit 2 and components of the indoor unit 9. The liquid-refrigerant connection pipe 4 and the gas-refrigerant connection pipe 5 connect the outdoor unit 2 to the indoor unit 9. In the air conditioning apparatus 1, the outdoor unit 2 and the indoor unit 9 are connected via the liquid-refrigerant connection pipe 4 and the gas-refrigerant connection pipe 5 to constitute a refrigerant circuit 6.

The air conditioning apparatus 1 illustrated in FIG. 1 includes one indoor unit 9. The air conditioning apparatus 1 may include a plurality of indoor units 9 connected in parallel to the outdoor unit 2 via the liquid-refrigerant connection pipe 4 and the gas-refrigerant connection pipe 5. The air conditioning apparatus 1 may alternatively include a plurality of outdoor units 2. The air conditioning apparatus 1 may alternatively include an outdoor unit 2 and an indoor unit 9 that are integrated with each other.

(1-1) Outdoor Unit

The outdoor unit 2 is installed outside the air conditioning target space. For example, the outdoor unit 2 is installed on the rooftop of a building or near a wall surface of a building.

The outdoor unit 2 mainly includes an accumulator 7, a compressor 8, a four-way switching valve 10, the outdoor heat exchanger 11, an expansion mechanism 12, a liquid-side shutoff valve 13, a gas-side shutoff valve 14, and an outdoor fan 16 (see FIG. 1).

The outdoor unit 2 mainly includes, as refrigerant pipes for connecting various components of the refrigerant circuit 6, a suction pipe 17, a discharge pipe 18, a first gas-refrigerant pipe 19, a liquid-refrigerant pipe 20, and a second gas-refrigerant pipe 21 (see FIG. 1). The suction pipe 17 connects the four-way switching valve 10 and a suction side of the compressor 8. The suction pipe 17 is provided with the accumulator 7. The discharge pipe 18 connects a discharge side of the compressor 8 and the four-way switching valve 10. The first gas-refrigerant pipe 19 connects the four-way switching valve 10 and a gas side of the outdoor heat exchanger 11. The liquid-refrigerant pipe 20 connects a liquid side of the outdoor heat exchanger 11 and the liquid-side shutoff valve 13. The liquid-refrigerant pipe 20 is provided with the expansion mechanism 12. The second gas-refrigerant pipe 21 connects the four-way switching valve 10 and the gas-side shutoff valve 14.

The compressor 8 is configured to suck in a low-pressure refrigerant in the refrigeration cycle, through the suction pipe 17, compress the refrigerant in a compression mechanism (not illustrated), and discharge the compressed refrigerant to the discharge pipe 18.

The four-way switching valve 10 is configured to switch a refrigerant flowing direction, thereby changing a state of the refrigerant circuit 6 between a cooling operation state and a heating operation state. When the refrigerant circuit 6 is in the cooling operation state, the outdoor heat exchanger 11 functions as a radiator (a condenser) for the refrigerant, and an indoor heat exchanger 91 functions as an evaporator for the refrigerant. When the refrigerant circuit 6 is in the heating operation state, the outdoor heat exchanger 11 functions as an evaporator for the refrigerant, and the indoor heat exchanger 91 functions as a condenser for the refrigerant. When the four-way switching valve 10 switches the state of the refrigerant circuit 6 to the cooling operation state, the four-way switching valve 10 causes the suction pipe 17 to communicate with the second gas-refrigerant pipe 21, and causes the discharge pipe 18 to communicate with the first gas-refrigerant pipe 19 (see a solid line in the four-way switching valve 10 illustrated in FIG. 1). When the four-way switching valve 10 switches the state of the refrigerant circuit 6 to the heating operation state, the four-way switching valve 10 causes the suction pipe 17 to communicate with the first gas-refrigerant pipe 19, and causes the discharge pipe 18 to communicate with the second gas-refrigerant pipe 21 (see a broken line in the four-way switching valve 10 illustrated in FIG. 1).

The outdoor heat exchanger 11 (which is an example of a heat exchanger) is configured to cause the refrigerant flowing therethrough to exchange heat with air (heat source air) in the place where the outdoor unit 2 is installed. A specific description on the outdoor heat exchanger 11 will be given later.

The expansion mechanism 12 is disposed between the outdoor heat exchanger 11 and the indoor heat exchanger 91 in the refrigerant circuit 6. In one or more embodiments, the expansion mechanism 12 is disposed on the liquid-refrigerant pipe 20 between the outdoor heat exchanger 11 and the liquid-side shutoff valve 13. In the air conditioning apparatus 1, the outdoor unit 2 includes the expansion mechanism 12. Alternatively, the indoor unit 9 (to be described later) may include the expansion mechanism 12. The expansion mechanism 12 is configured to adjust a pressure and a flow rate of the refrigerant flowing through the liquid-refrigerant pipe 20. In one or more embodiments, the expansion mechanism 12 is an opening degree-changeable electronic expansion valve. The expansion mechanism 12 may alternatively be a feeler bulb-type expansion valve or a capillary tube.

The accumulator 7 has a gas-liquid separating function of separating the refrigerant, which flows thereinto, into the gas refrigerant and the liquid refrigerant. The accumulator 7 also has a surplus refrigerant storing function of storing a surplus of the refrigerant in accordance with, for example, a variation in operation load.

The liquid-side shutoff valve 13 is disposed on a joint between the liquid-refrigerant pipe 20 and the liquid-refrigerant connection pipe 4. The gas-side shutoff valve 14 is disposed on a joint between the second gas-refrigerant pipe 21 and the gas-refrigerant connection pipe 5. The liquid-side shutoff valve 13 and the gas-side shutoff valve 14 are open during the operation of the air conditioning apparatus 1.

The outdoor fan 16 is configured to take heat source air from the outside in a casing (not illustrated) of the outdoor unit 2, supply the heat source air to the outdoor heat exchanger 11, and discharge the air subjected to heat exchange with the refrigerant in the outdoor heat exchanger 11, to the outside of the casing of the outdoor unit 2. The outdoor fan 16 is, for example, a propeller fan.

(1-2) Indoor Unit

The indoor unit 9 is installed in the air conditioning target space. For example, the indoor unit 9 is designed to be embedded in a ceiling. The indoor unit 9 may alternatively be designed to be suspended from a ceiling, hung on a wall, or placed on a floor. Alternatively, the indoor unit 9 may be installed outside the air conditioning target space. For example, the indoor unit 9 may be installed in an attic, a machine chamber, a garage, or the like. In this case, an air passage is provided for supplying air subjected to heat exchange with the refrigerant in the indoor heat exchanger 91, from the indoor unit 9 to the air conditioning target space. The air passage is, for example, a duct.

The indoor unit 9 mainly includes the indoor heat exchanger 91 and an indoor fan 92 (see FIG. 1).

The indoor heat exchanger 91 causes the refrigerant flowing therethrough to exchange heat with the air in the air conditioning target space. The indoor heat exchanger 91 may be of any type. For example, the indoor heat exchanger 91 may be a fin-and-tube heat exchanger that includes a plurality of heat transfer tubes and a plurality of fins (not illustrated). The indoor heat exchanger 91 has a first end connected to the liquid-refrigerant connection pipe 4 via a refrigerant pipe. The indoor heat exchanger 91 has a second end connected to the gas-refrigerant connection pipe 5 via a refrigerant pipe.

The indoor fan 92 is configured to suck air in the air conditioning target space into a casing (not illustrated) of the indoor unit 9, supply the air to the indoor heat exchanger 91, and blow out the air subjected to heat exchange with the refrigerant in the indoor heat exchanger 91 toward the air conditioning target space. The indoor fan 92 is, for example, a turbo fan. The indoor fan 92 is not limited to a turbo fan, and a fan of any type may be appropriately selected as the indoor fan 92.

(1-3) Control Unit

The control unit 3 is a functional unit configured to control the operations of the various components of the air conditioning apparatus 1.

For example, the control unit 3 includes an outdoor control unit (not illustrated) of the outdoor unit 2 and an indoor control unit (not illustrated) of the indoor unit 9 that are connected to communicate with each other via a transmission line (not illustrated). Each of the outdoor control unit and the indoor control unit includes, for example, a microcomputer and a memory storing various programs for controlling the air conditioning apparatus 1, the programs being executable by the microcomputer. For sake of convenience, FIG. 1 depicts the control unit 3 at a position away from the outdoor unit 2 and the indoor unit 9.

The functions of the control unit 3 are not necessarily achieved by the cooperation of the outdoor control unit and the indoor control unit. For example, the functions of the control unit 3 may be achieved by one of the outdoor control unit and the indoor control unit. Alternatively, some of or all the functions of the control unit 3 may be achieved by a control device (not illustrated) different from the outdoor control unit and the indoor control unit.

As illustrated in FIG. 1, the control unit 3 is electrically connected to various components (including the compressor 8, the four-way switching valve 10, the expansion mechanism 12, the outdoor fan 16, and the indoor fan 92) of the outdoor unit 2 and indoor unit 9. The control unit 3 is also electrically connected to various sensors (not illustrated) in the outdoor unit 2 and indoor unit 9. The control unit 3 is capable of communicating with a remote controller (not illustrated) to be operated by a user of the air conditioning apparatus 1.

The control unit 3 starts or stops an operation of the air conditioning apparatus 1 and controls the operations of the various components of the air conditioning apparatus 1, based on, for example, measurement signals from the various sensors and commands from the remote controller (not illustrated).

(2) Configuration of Outdoor Heat Exchanger

Next, a description will be given of a configuration of the outdoor heat exchanger 11 with reference to the drawings.

Figure 2:
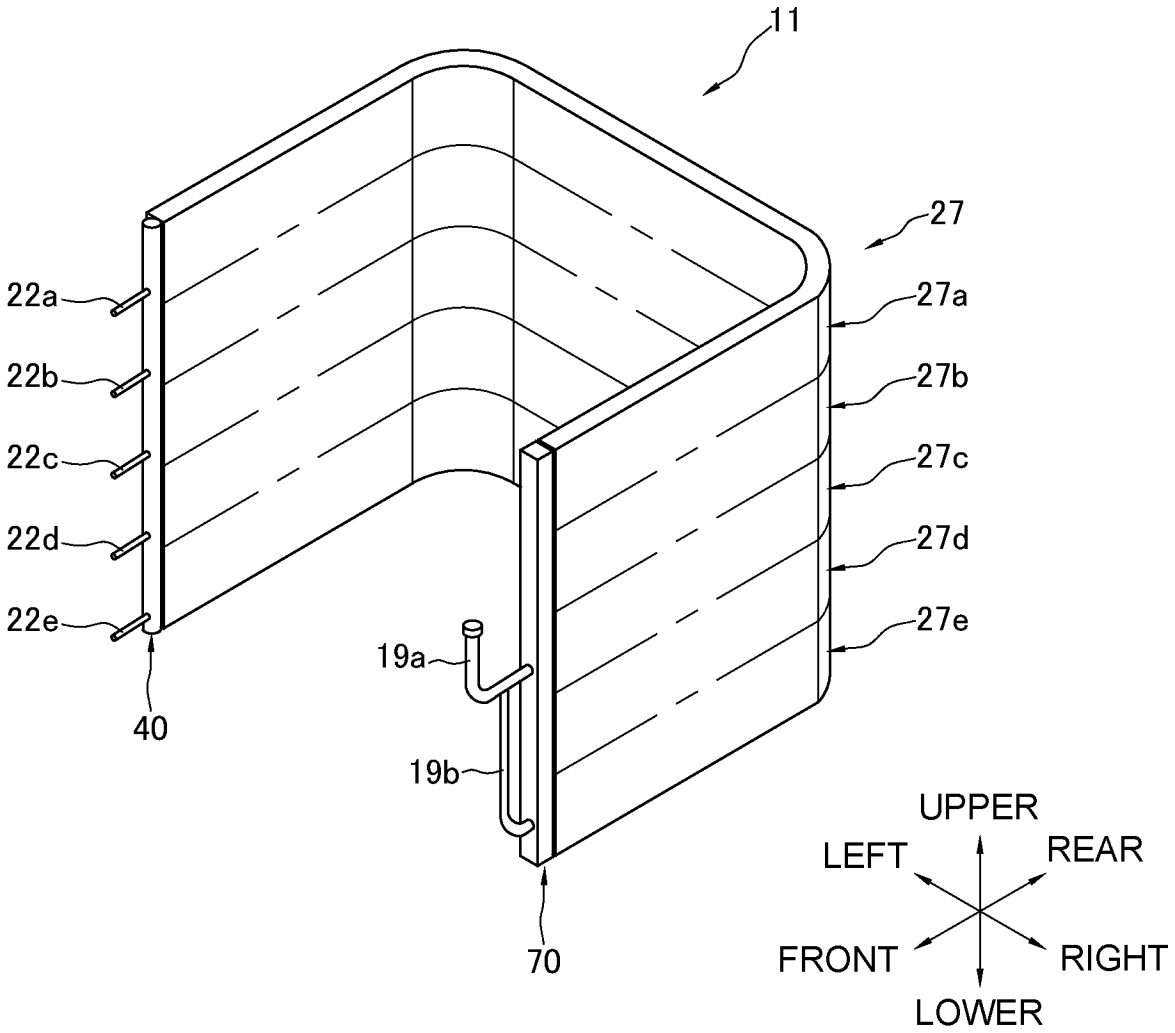
FIG. 2 is a schematic perspective view of an outdoor heat exchanger.
Figure 3:
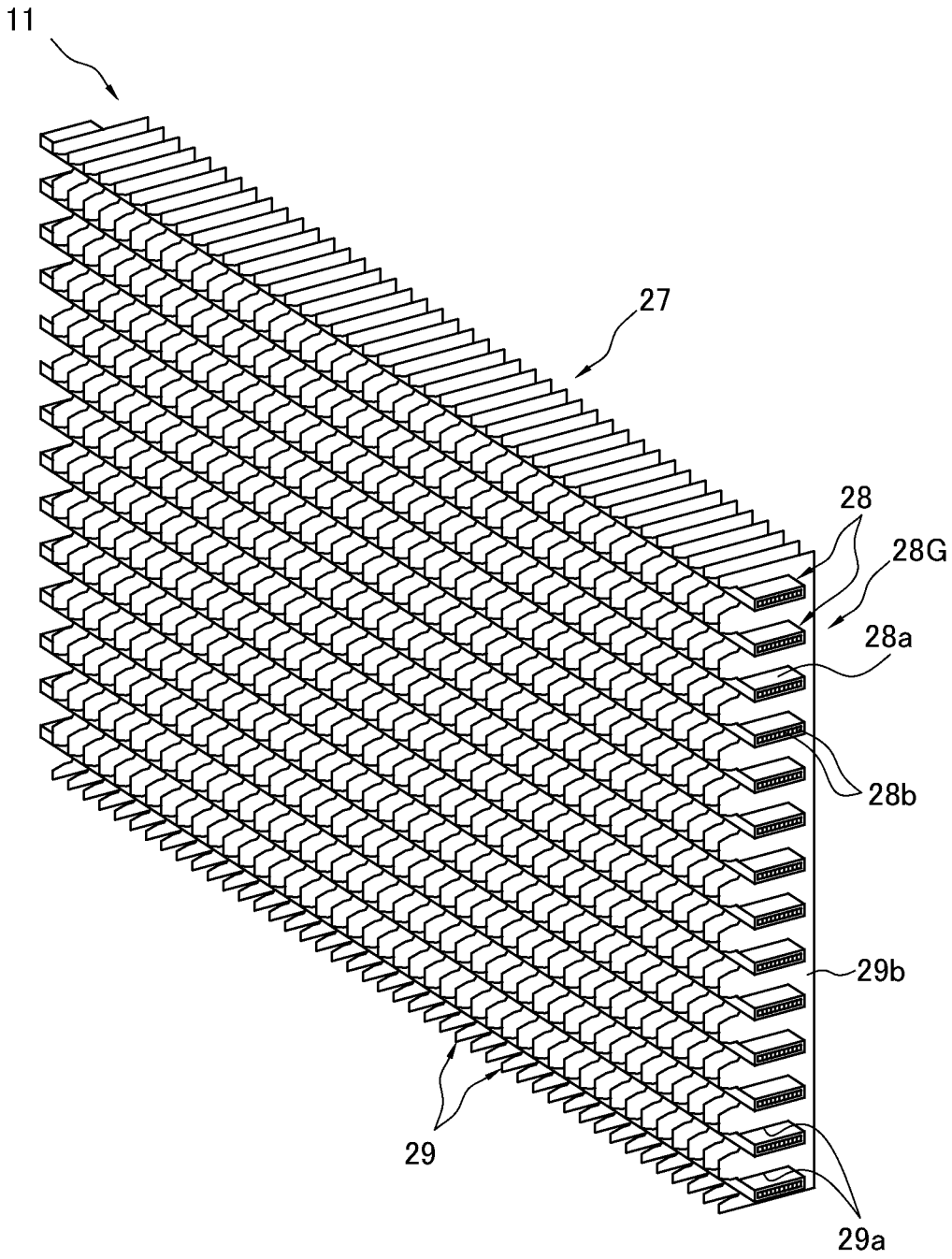
FIG. 3 is a partially enlarged view of a heat exchange part of the outdoor heat exchanger.
Figure 4:
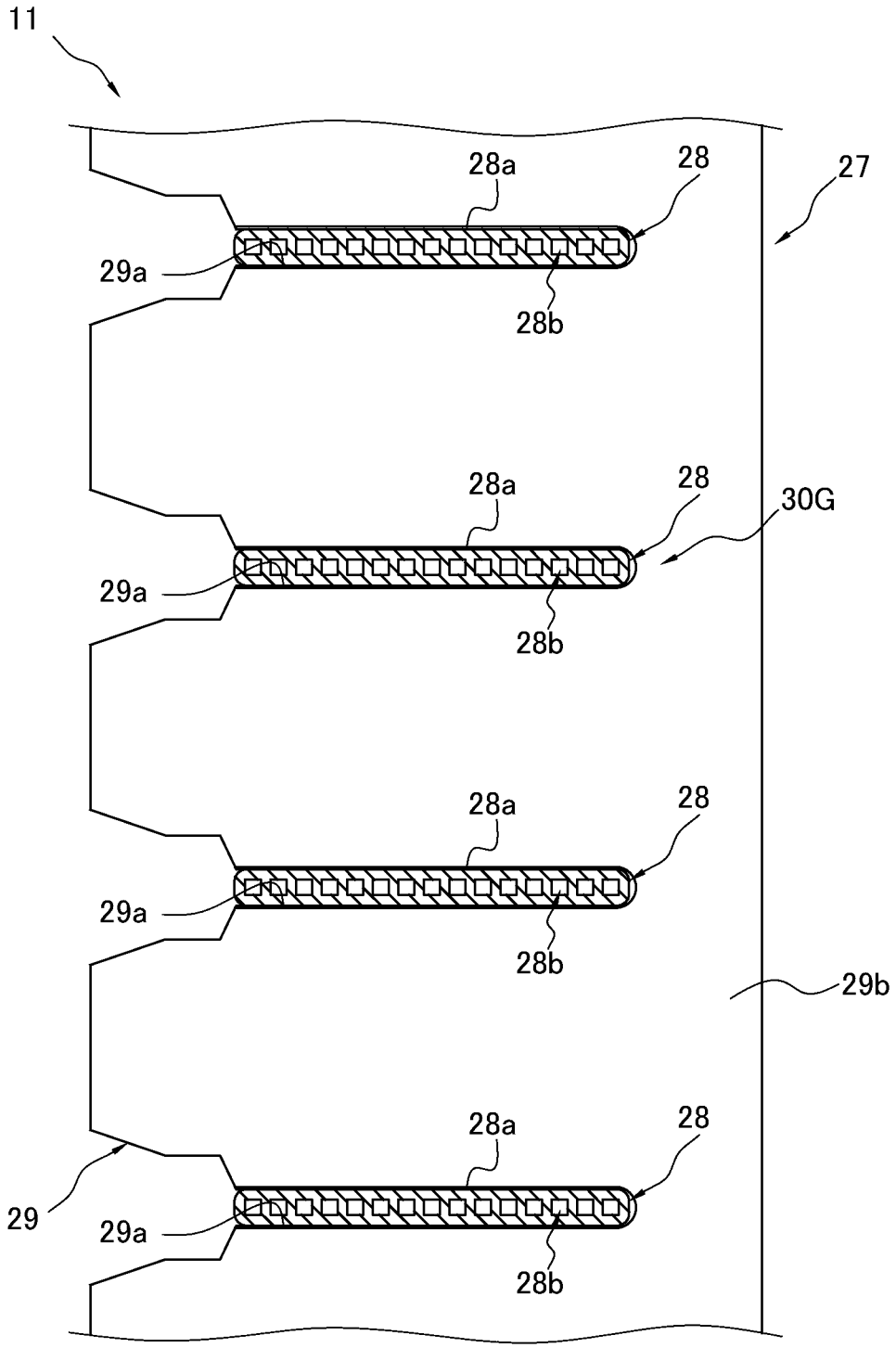
FIG. 4 is a schematic diagram of the heat exchange part in which a heat transfer fin is mounted to a flat tube.
Figure 5:
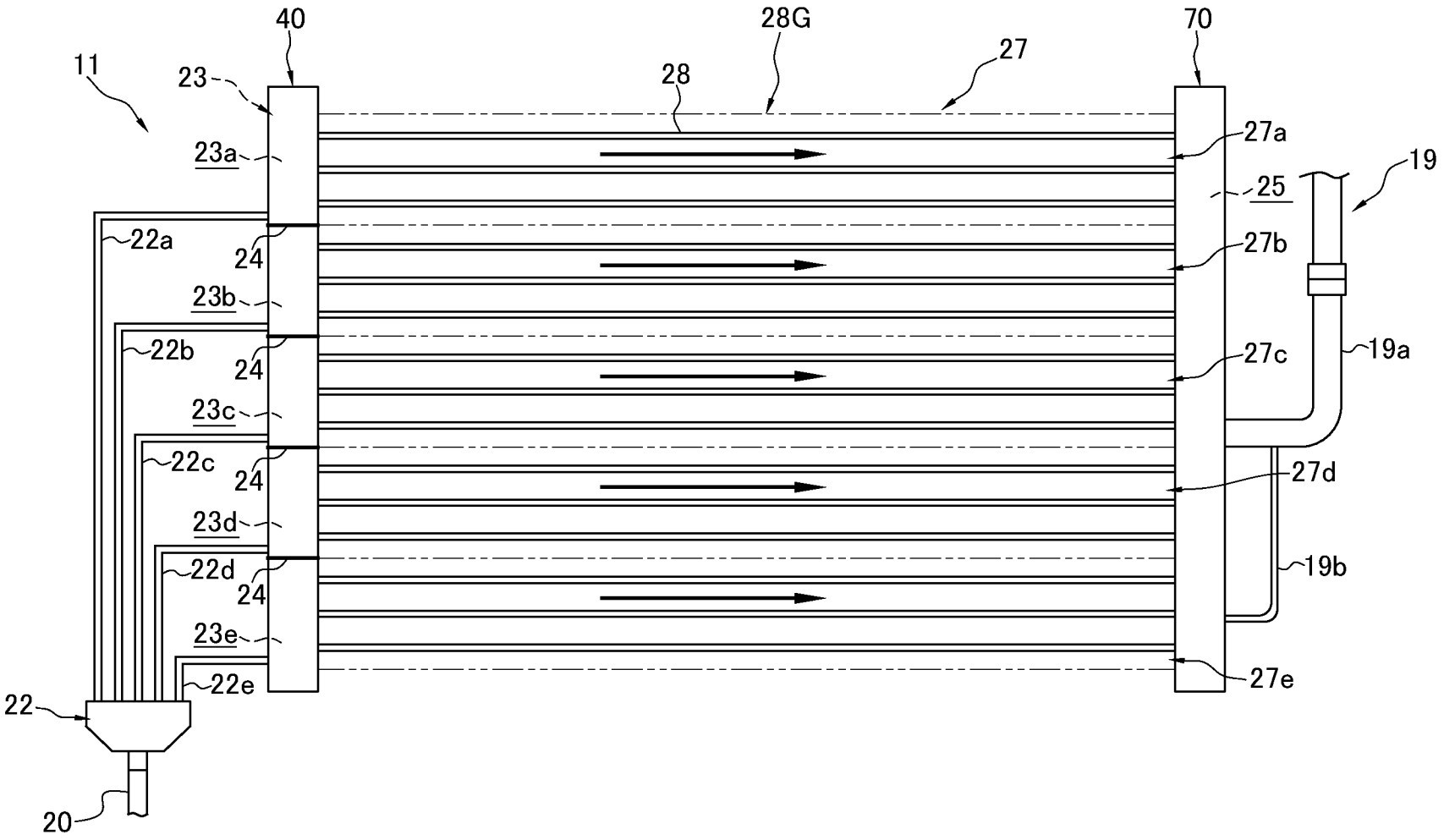
FIG. 5 is a diagram of a flow of a refrigerant in the outdoor heat exchanger functioning as an evaporator for the refrigerant.

FIG. 2 is a schematic perspective view of the outdoor heat exchanger 11. FIG. 3 is a partially enlarged view of a heat exchange part 27 (to be described later) of the outdoor heat exchanger 11. FIG. 4 is a schematic diagram of the heat exchange part 27 in which a fin 29 is mounted to a flat tube 28 (which will be described later). FIG. 5 is a schematic configuration diagram of the outdoor heat exchanger 11. In FIG. 5, arrows depicted in the heat exchange part 27 each indicate a flow of the refrigerant during the heating operation (in which the outdoor heat exchanger 11 functions as an evaporator).

In the following, orientations and positions are sometimes described using the terms "upper (up)", "lower (down)", "left", "right", "front (front face)", and "rear (rear face)". These orientations and positions are defined by the arrows depicted in FIG. 2 unless otherwise specified. It should be noted that the terms representing the orientations and positions are used for sake of convenience of the description and therefore do not specify the orientation and position of the entire outdoor heat exchanger 11 and the orientation and position of each component of the outdoor heat exchanger 11 unless otherwise specified.

The outdoor heat exchanger 11 is configured to cause the refrigerant flowing therethrough to exchange heat with air.

The outdoor heat exchanger 11 mainly includes a distributor 22, a flat tube group 28G that includes the plurality of flat tubes 28, the plurality of fins 29, a liquid header 40, and a gas header 70 (which is an example of a header) (see FIGS. 4 and 5). In one or more embodiments, the distributor 22, the flat tubes 28, the fins 29, the liquid header 40, and the gas header 70 are each made of aluminum or an aluminum alloy.

As will be described later, the flat tubes 28 and the fins 29 fixed to the flat tubes 28 constitute the heat exchange part 27 (see FIGS. 2 and 3). The outdoor heat exchanger 11 includes the heat exchange part 27 placed in a line; therefore, the configuration of the outdoor heat exchanger 11 is different from that in which the flat tubes 28 are arranged in the air flowing direction. In the outdoor heat exchanger 11, air flows through an air flow path defined by each flat tube 28 and the corresponding fin 29 in the heat exchange part 27. The outdoor heat exchanger 11 causes the refrigerant flowing through each flat tube 28 to exchange heat with the air flowing through the corresponding air flow path. The heat exchange part 27 is divided into a first heat exchange part 27*a*, a second heat exchange part 27*b*, a third heat exchange part 27*c*, a fourth heat exchange part 27*d*, and a fifth heat exchange part 27*e* arranged in the up-and-down direction (see FIG. 2).

(2-1) Distributor

The distributor 22 is configured to divert the refrigerant. The distributor 22 is also configured to merge the diverted refrigerants into one. The liquid-refrigerant pipe 20 is connected to the distributor 22. The distributor 22 includes a plurality of distributor tubes 22*a* to 22*e*. The distributor 22 has a function of diverting the refrigerant flowing thereinto through the liquid-refrigerant pipe 20 into the distributor tubes 22*a* to 22*e* and leading the diverted refrigerants to spaces defined in the liquid header 40. The distributor 22 also has a function of merging the refrigerants flowing thereinto from the liquid header 40 via the distributor tubes 22*a* to 22*e* into one and leading the refrigerant toward the liquid-refrigerant pipe 20.

(2-2) Flat Tube Group

The flat tube group 28G is an example of a heat transfer tube group. The flat tube group 28G includes the plurality of flat tubes 28 (each of which is an example of a heat transfer tube) as a plurality of heat transfer tubes. As illustrated in FIG. 3, each of the flat tubes 28 is a flat heat transfer tube having upper and lower flat faces 28*a* each serving as a heat transfer face. As illustrated in FIG. 3, each of the flat tubes 28 includes a plurality of refrigerant passages 28*b* through which the refrigerant flows. Each of the flat tubes 28 is, for example, a flat porous pipe including a plurality of refrigerant passages 28*b* each allowing the refrigerant to flow therethrough and having a small passage sectional area. In one or more embodiments, the refrigerant passages 28*b* are arranged in the air flowing direction. A maximum width of each of the flat tubes 28 in cross section perpendicular to the refrigerant passages 28*b* may be 70% or more and alternatively be 85% or more of the outer diameter of the main gas-refrigerant pipe connection portion 19*a*.

As illustrated in FIG. 5, in the outdoor heat exchanger 11, the flat tubes 28 extend between the liquid header 40 and the gas header 70 in a horizontal direction. Moreover, the flat tubes 28 are arranged up and down in multiple tiers. In one or more embodiments, the flat tubes 28 between the liquid header 40 and the gas header 70 are bent at two points, so that the heat exchange part 27 including the flat tubes 28 has a substantially "U" shape as seen in plan view (see FIG. 2). The flat tubes 28 each have a portion that extends in a front-and-rear direction (which is an example of a first direction) and is connected to the gas header 70, and a portion that extends in the front-and-rear direction and is connected to the liquid header 40. In one or more embodiments, the flat tubes 28 are arranged up and down at certain spacings.

(2-3) Fin

The fins 29 are used for increasing a heat transfer area of the outdoor heat exchanger 11. The fins 29 each have a plate shape extending in a direction in which the flat tubes 28 are arranged in tiers. The outdoor heat exchanger 11 is used in the state in which the flat tubes 28 extending in the horizontal direction are arranged in the up-and-down direction. Therefore, the fins 29 extend in the up-and-down direction with the outdoor heat exchanger 11 installed in the outdoor unit 2.

As illustrated in FIG. 4, each of the fins 29 has a plurality of cutouts 29*a* extending in such a direction that the flat tubes 28 are inserted into the cutouts 29*a*. The cutouts 29*a* extend in the direction in which the fins 29 extend and in a direction orthogonal to a thickness direction of each fin 29. The cutouts 29*a* in each fin 29 extend in the horizontal direction with the outdoor heat exchanger 11 installed in the outdoor unit 2. The cutouts 29*a* in each fin 29 each have a shape that is almost equal to an outer cross-sectional shape of each flat tube 28. In each fin 29, a spacing between adjacent two of the cutouts 29*a* corresponds to the spacing between adjacent two of the flat tubes 28. In the outdoor heat exchanger 11, the fins 29 are arranged in the direction in which the flat tubes 28 extend. In each of the fins 29, the flat tubes 28 are respectively inserted into the cutouts 29*a*, so that a plurality of air flow paths, through which air flows, are defined between adjacent two of the flat tubes 28.

Each of the fins 29 has a communicating portion 29*b* disposed upstream or downstream of the flat tubes 28 in the air flowing direction. The communicating portions 29*b* extend in the up-and-down direction. In one or more embodiments, the communicating portions 29*b* of the fins 29 are located on the windward side with respect to the flat tubes 28.

(2-4) Gas Header, Liquid Header

The liquid header 40 and the gas header 70 each have a hollow shape.

As illustrated in FIG. 5, the liquid header 40 is connected to a first end of each flat tube 28, and the gas header 70 is connected to a second end of each flat tube 28. The outdoor heat exchanger 11 is disposed in the casing (not illustrated) of the outdoor unit 2 such that an axial direction of each of the liquid header 40 and the gas header 70 each having a substantially columnar shape is approximately parallel to a vertical direction. In one or more embodiments, as illustrated in FIG. 2, the heat exchange part 27 of the outdoor heat exchanger 11 has the "U" shape as seen in plan view. The liquid header 40 is disposed near the front left corner of the casing (not illustrated) of the outdoor unit 2 (see FIG. 2). The gas header 70 is disposed near the front right corner of the casing (not illustrated) of the outdoor unit 2 (see FIG. 2).

(2-4-1) Liquid Header

The liquid header 40 has a longitudinal direction parallel to the up-and-down direction.

The liquid header 40 has a liquid-side internal space 23 divided into a plurality of sub-spaces 23*a* to 23*e* by a plurality of partition plates 24 (see FIG. 5).

The sub-spaces 23*a* to 23*e* are arranged in the up-and-down direction. The sub-spaces 23*a* to 23*e* of the liquid-side internal space 23 divided by the partition plates 24 are in a non-communicating state in the liquid header 40.

The distributor tubes 22*a* to 22*e* of the distributor 22 are respectively connected to the sub-spaces 23*a* to 23*e*. During the cooling operation, when the refrigerant flows into each of the sub-spaces 23*a* to 23*e*, the refrigerants then flow through the distributor tubes 22*a* to 22*e*. The refrigerants are then merged into one at the distributor 22. During the heating operation, when the refrigerant flows into the distributor 22, the distributor 22 supplies the diverted refrigerants to the sub-spaces 23*a* to 23*e*.

(2-4-2) Gas Header

The gas header 70 has a longitudinal direction parallel to the up-and-down direction (which is an example of a second direction).

The gas header 70 has a single space. The gas header 70 has a gas-side internal space 25 that is not divided by partition plates, unlike the liquid-side internal space 23 divided into the sub-spaces 23*a* to 23*e* arranged up and down in the liquid header 40.

The gas header 70 is connected to a main gas-refrigerant pipe connection portion 19*a* (which is an example of a first pipe and a gas pipe) and a branch gas-refrigerant pipe connection portion 19*b* (which is an example of a first pipe and a gas pipe). The main gas-refrigerant pipe connection portion 19*a* and the branch gas-refrigerant pipe connection portion 19*b* each constitute a gas header 70-side end of the first gas-refrigerant pipe 19 (which is an example of a first pipe and a gas pipe) (see FIG. 5). The main gas-refrigerant pipe connection portion 19*a* has an outer diameter that is not limited. For example, the outer diameter of the main gas-refrigerant pipe connection portion 19*a* may be 3 times or more larger and alternatively 5 times or more larger than the outer diameter of the branch gas-refrigerant pipe connection portion 19*b*.

The main gas-refrigerant pipe connection portion 19*a* has a first end connected to the gas header 70 to communicate with the gas-side internal space 25 (which is an example of a space defined by a first wall and a second wall) at an intermediate position of the gas header 70 in a height direction.

The branch gas-refrigerant pipe connection portion 19*b* has a first end connected to the gas header 70 to communicate with the gas-side internal space 25 at a position near a lower end of the gas header 70 in the height direction. The branch gas-refrigerant pipe connection portion 19*b* has a second end connected to the main gas-refrigerant pipe connection portion 19*a*. The branch gas-refrigerant pipe connection portion 19*b* is smaller in inner diameter than the main gas-refrigerant pipe connection portion 19*a*. The branch gas-refrigerant pipe connection portion 19*b* is connected to the gas header 70 at a position below the main gas-refrigerant pipe connection portion 19*a*. A refrigerating machine oil retained near the lower end of the gas header 70 is thus drawn into the main gas-refrigerant pipe connection portion 19*a*.

(3) Flow of Refrigerant in Outdoor Heat Exchanger

In a case where the air conditioning apparatus 1 carries out the heating operation so that the outdoor heat exchanger 11 functions as an evaporator for the refrigerant, the refrigerant in the gas-liquid two-phase state flows into the distributor 22 through the liquid-refrigerant pipe 20. The diverted refrigerants then flow through the distributor tubes 22*a* to 22*e* and flow into the sub-spaces 23*a* to 23*e* of the liquid-side internal space 23 in the liquid header 40. Specifically, the refrigerant flowing through the distributor tube 22*a* flows into the sub-space 23*a*, the refrigerant flowing through the distributor tube 22*b* flows into the sub-space 23*b*, the refrigerant flowing through the distributor tube 22*c* flows into the sub-space 23*c*, the refrigerant flowing through the distributor tube 22*d* flows into the sub-space 23*d*, and the refrigerant flowing through the distributor tube 22*e* flows into the sub-space 23*e*. When the refrigerants flow into the sub-spaces 23*a* to 23*e* of the liquid-side internal space 23, then the refrigerants flow through the flat tubes 28 respectively connected to the sub-spaces 23*a* to 23*e*. The refrigerants flowing through the flat tubes 28 evaporate by heat exchange with air, so that the gas-phase refrigerants flow into the gas-side internal space 25 in the gas header 70. The gas-phase refrigerants are thus merged into one.

In a case where the air conditioning apparatus 1 carries out the cooling operation or a defrosting operation, the refrigerant flows through the refrigerant circuit 6 in the opposite direction to that during the heating operation. Specifically, the high-temperature gas-phase refrigerant flows into the gas-side internal space 25 in the gas header 70 through the main gas-refrigerant pipe connection portion 19*a* and branch gas-refrigerant pipe connection portion 19*b* of the first gas-refrigerant pipe 19. The refrigerant is diverted in the gas-side internal space 25 in the gas header 70, and the diverted refrigerants then flow into the flat tubes 28. The refrigerants flowed into the flat tubes 28 then flow through the flat tubes 28 and flow into the sub-spaces 23*a* to 23*e* of the liquid-side internal space 23 in the liquid header 40. The refrigerants flowed into the sub-spaces 23*a* to 23*e* of the liquid-side internal space 23 are then merged into one in the distributor 22. The merged refrigerant then flows into the liquid-refrigerant pipe 20.

(4) Details of Gas Header

Figure 6:
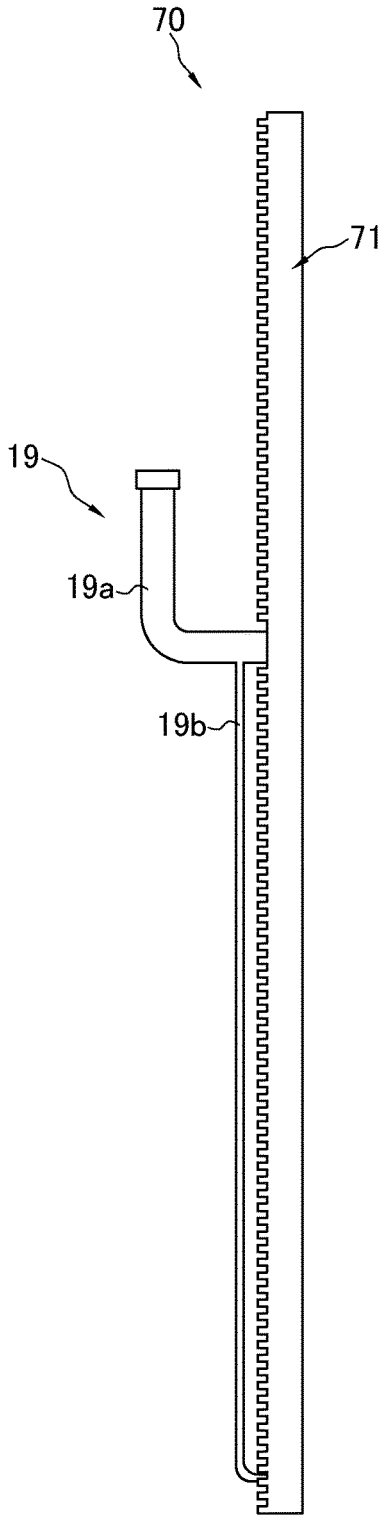
FIG. 6 is an external view of a gas header to which a main gas-refrigerant pipe connection portion is connected as seen in side view.
Figure 7:
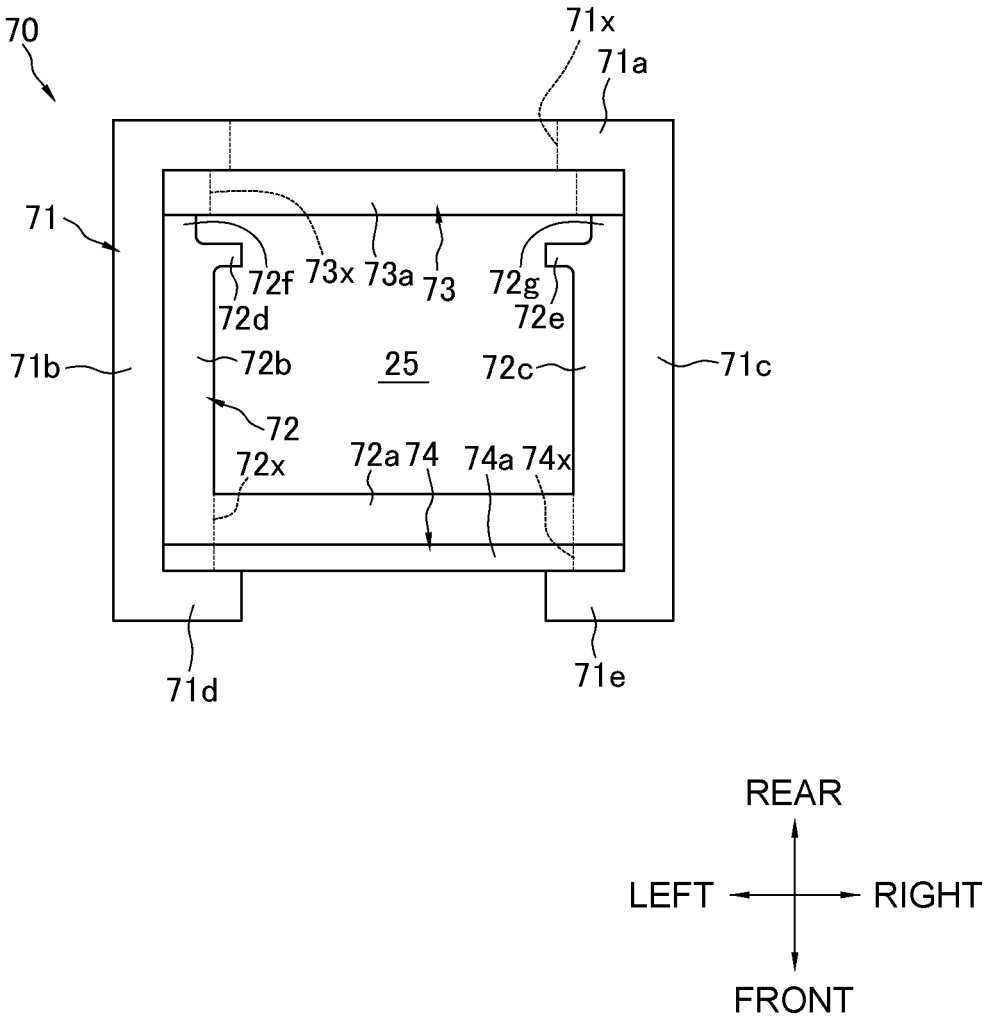
FIG. 7 is a sectional view of the gas header as seen in plan view.
Figure 8:
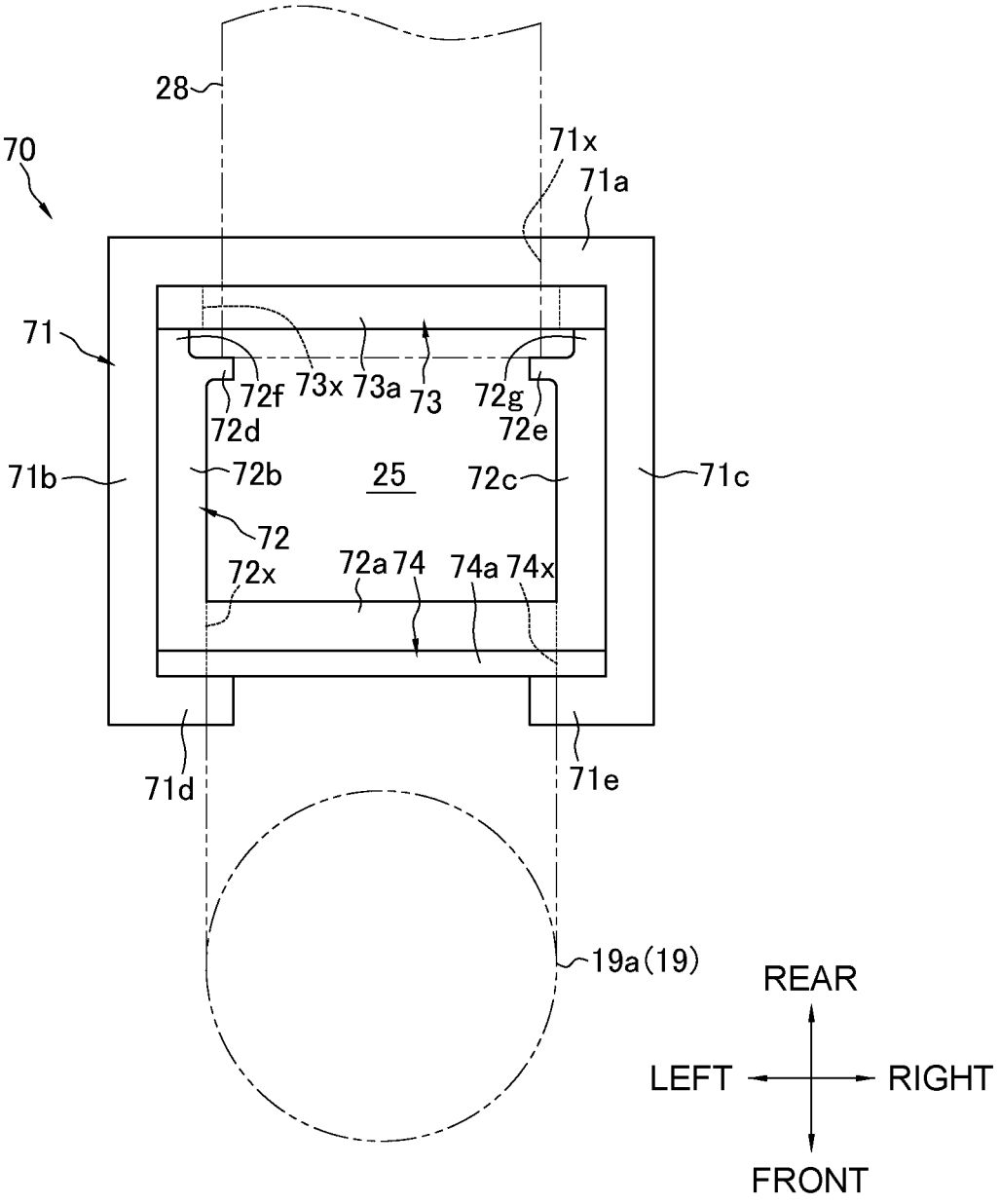
FIG. 8 is a sectional view of the gas header to which the main gas-refrigerant pipe connection portion and the flat tube are connected as seen in plan view.

FIG. 6 is an external view of the gas header 70 to which the main gas-refrigerant pipe connection portion 19*a* is connected as seen in side view. FIG. 7 is a sectional view of the gas header 70 as seen in plan view. FIG. 8 is a sectional view of the gas header 70 to which the main gas-refrigerant pipe connection portion 19*a* and the flat tubes 28 are connected as seen in plan view.

Figure 9:
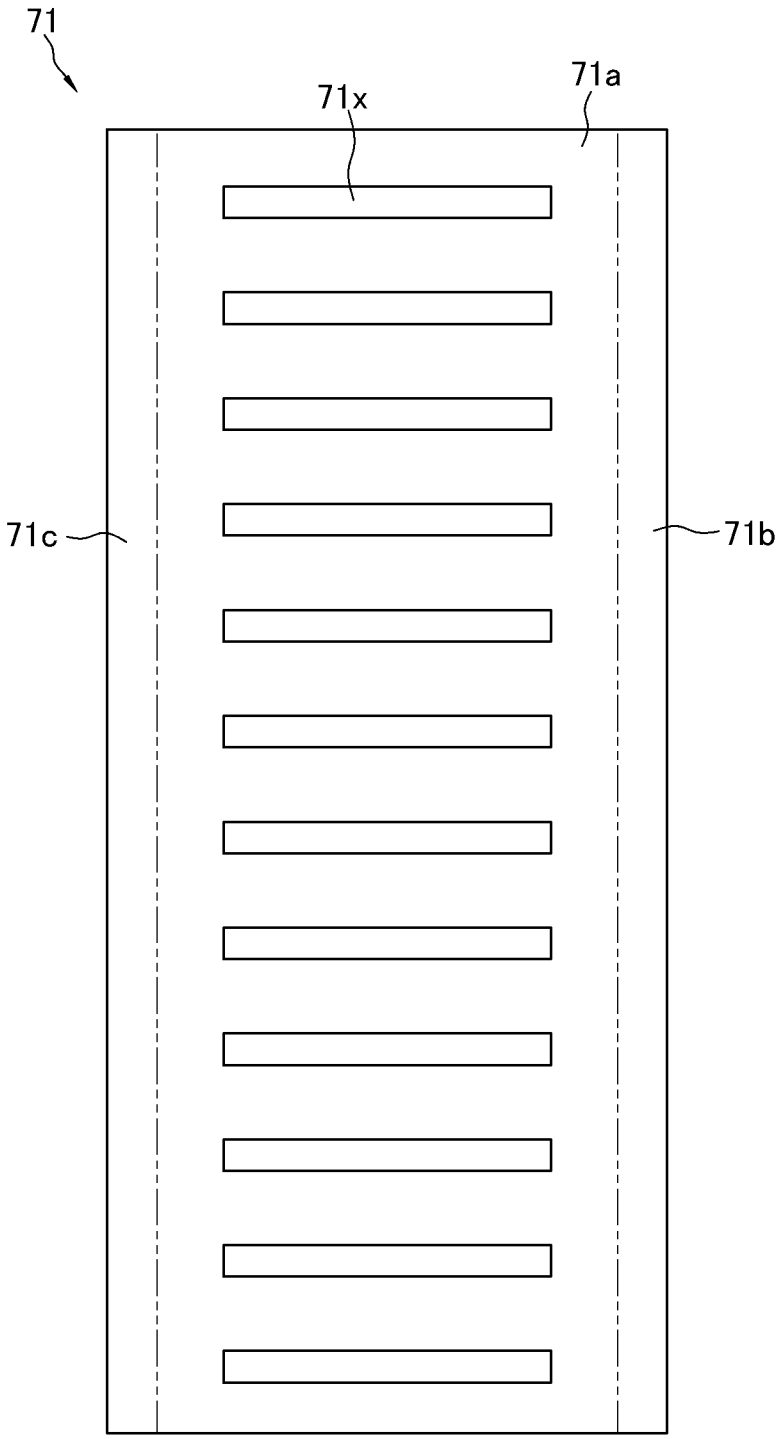
FIG. 9 is a schematic diagram of a rear side of a first member.
Figure 10:
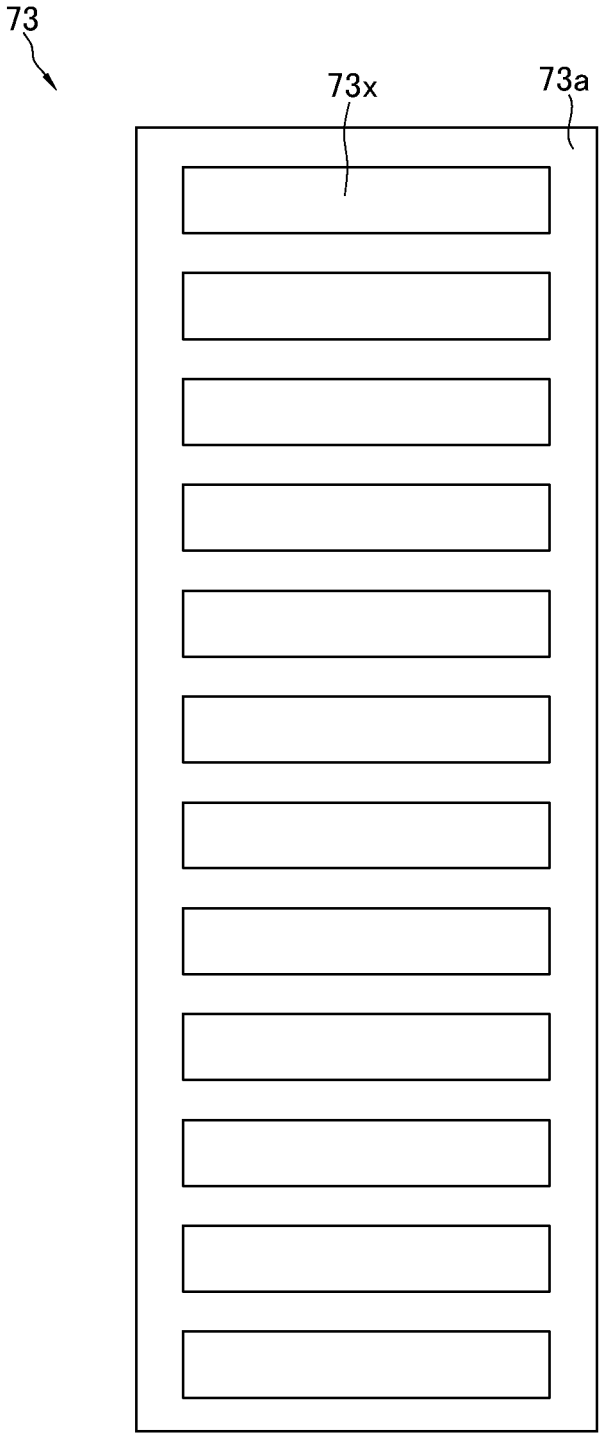
FIG. 10 is a schematic diagram of a rear side of a third member.
Figure 11:
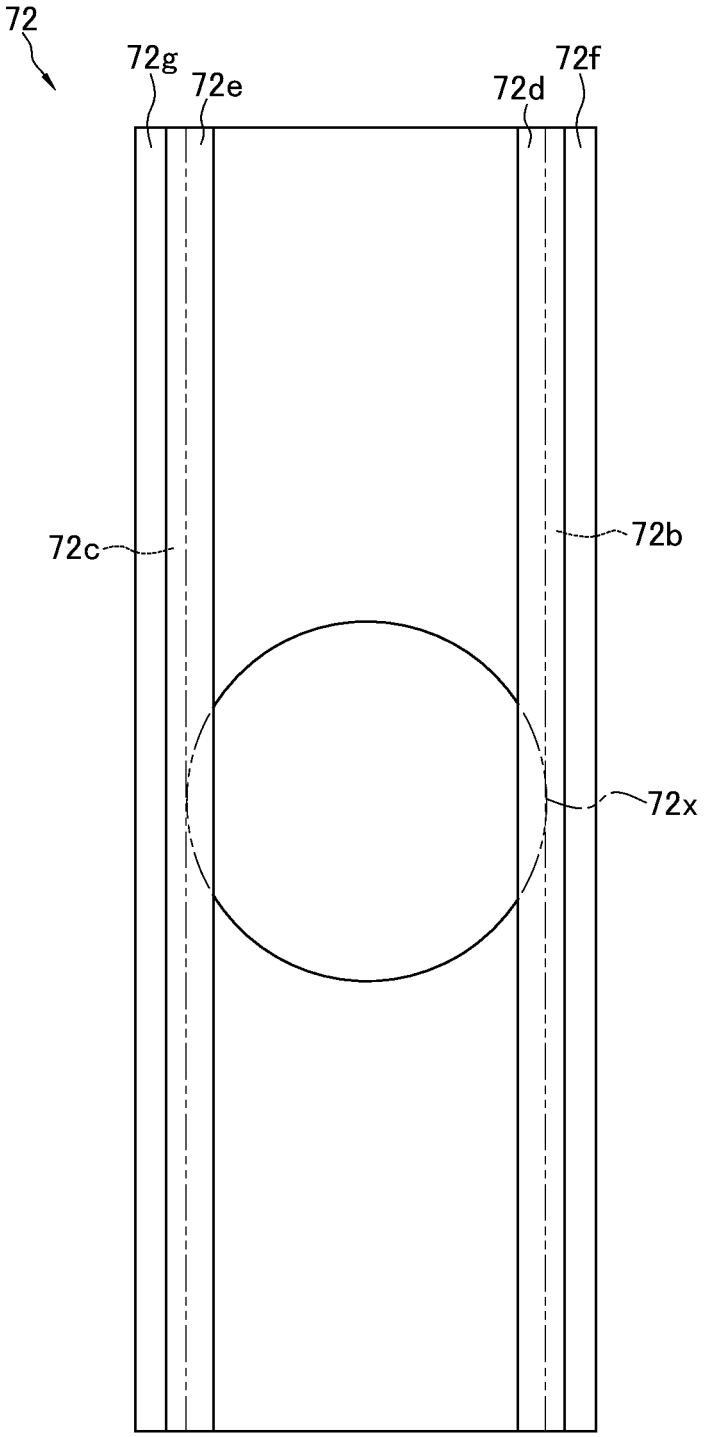
FIG. 11 is a schematic diagram of a rear side of a second member.
Figure 12:
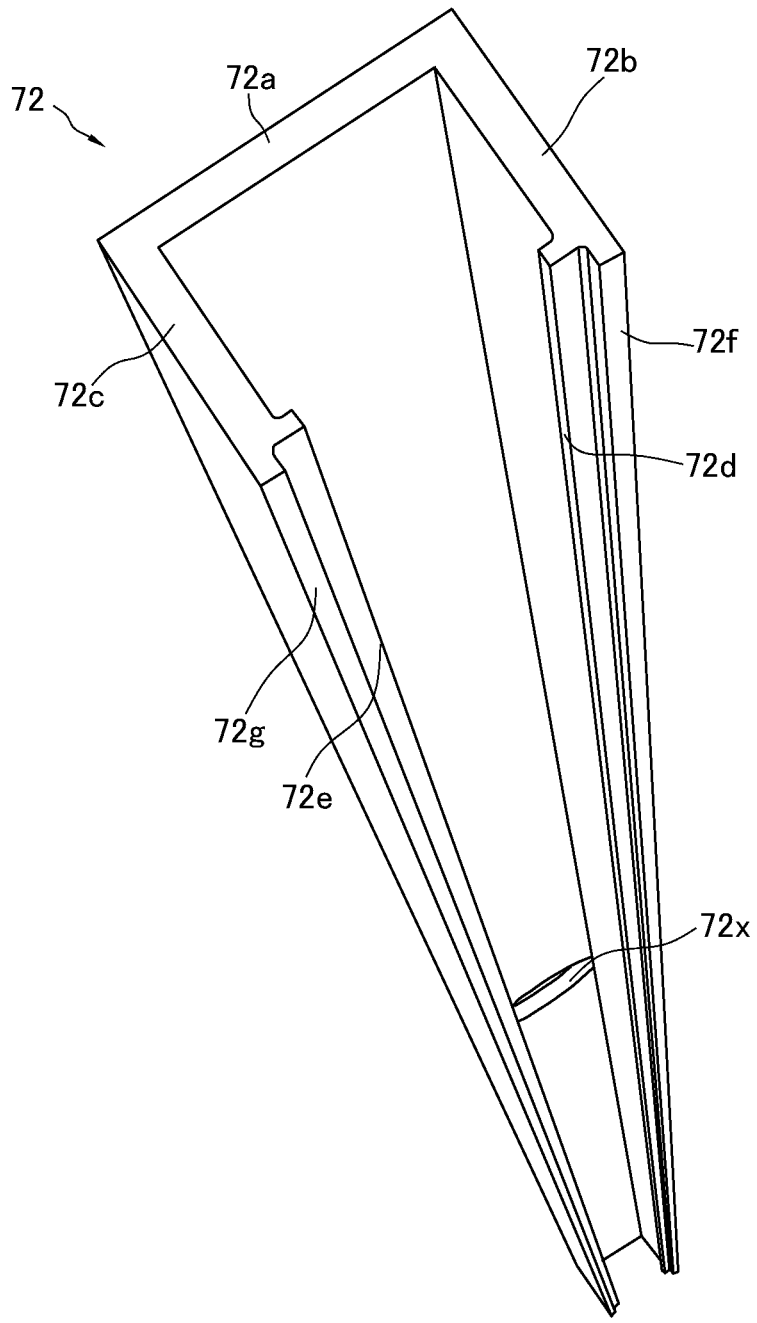
FIG. 12 is an external perspective view of the second member.
Figure 13:
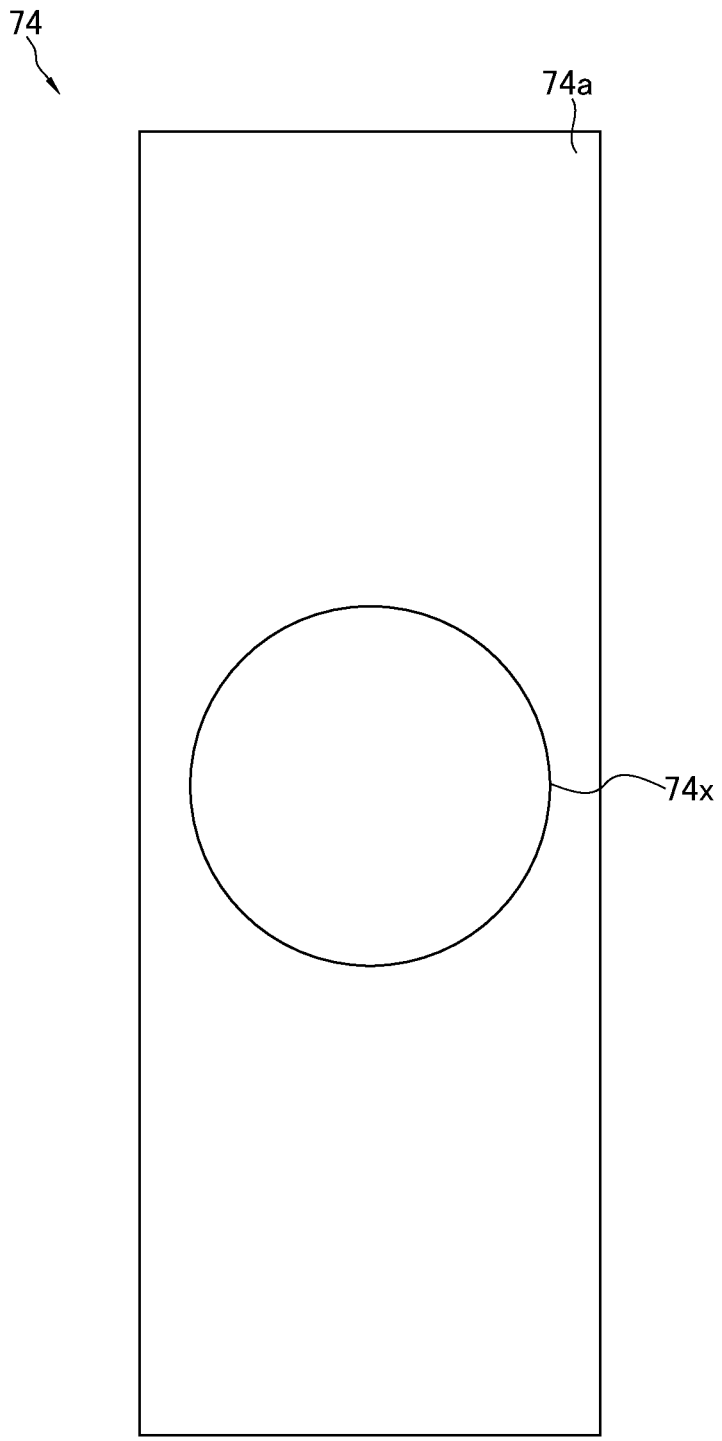
FIG. 13 is a schematic diagram of a rear side of a fourth member.
Figure 14:
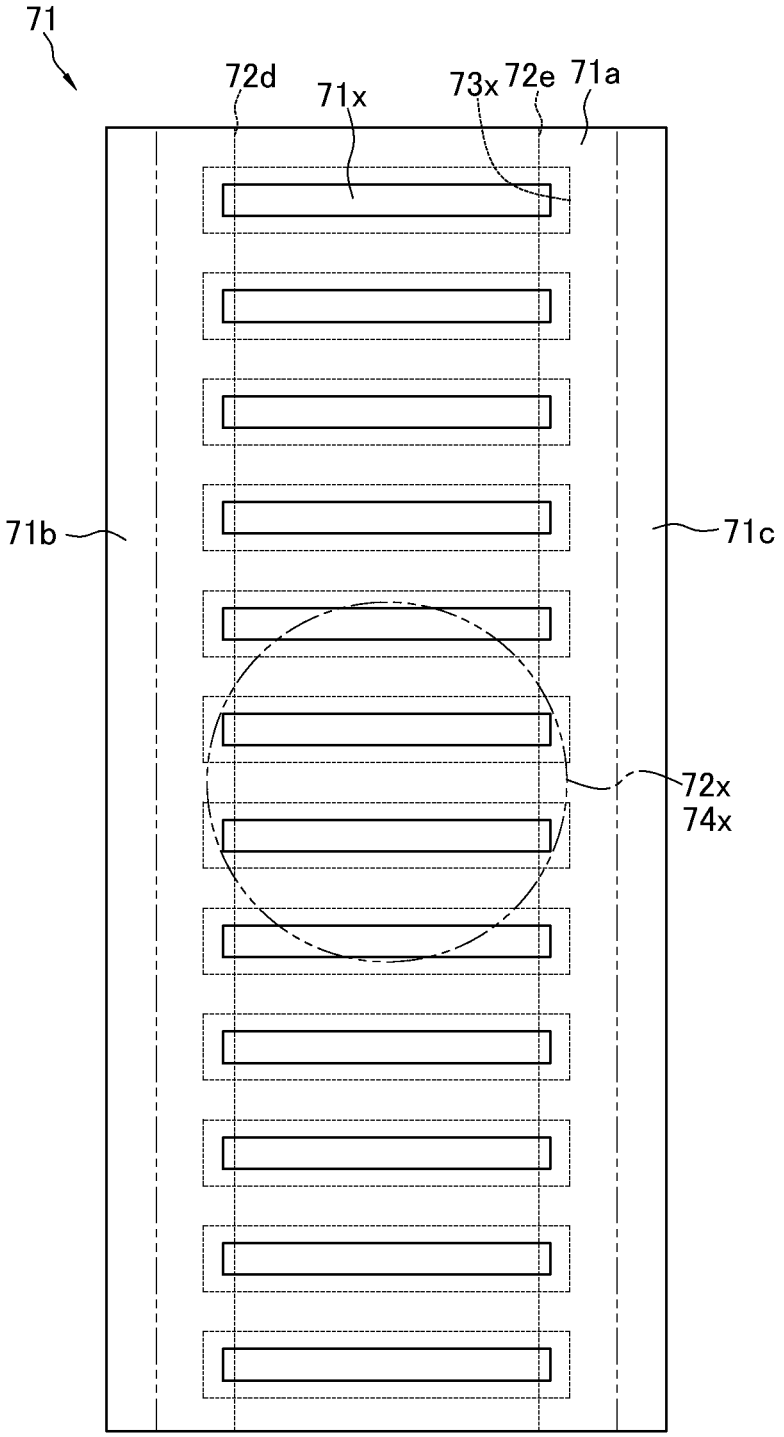
FIG. 14 is a projection view of a positional relationship among openings in a case where the first member is seen from its rear side.

FIG. 9 is a schematic diagram of a rear side of a first member 71. FIG. 10 is a schematic diagram of a rear side of a third member 73. FIG. 11 is a schematic diagram of a rear side of a second member 72. FIG. 12 is an external perspective view of the second member 72. FIG. 13 is a schematic diagram of a rear side of a fourth member 74. FIG. 14 is a projection view of a positional relationship among openings in a case where the first member 71 is seen from its rear side.

The gas header 70 includes the first member 71, the second member 72, the third member 73, the fourth member 74, an upper-end cover member (not illustrated), and a lower-end cover member (not illustrated). In the gas header 70, the first member 71, the second member 72, the third member 73, the fourth member 74, the upper-end cover member, and the lower-end cover member are joined together by brazing.

The gas header 70 has a substantially quadrangle outer shape as seen in plan view, and one of the four sides is connected to the flat tubes 28.

(4-1) First Member

The first member 71 mainly forms an outer shape of the gas header 70 in conjunction with the fourth member 74 (to be described later). Preferably, the first member 71 has on its surface a cladding layer containing a brazing material.

The first member 71 includes a flat tube connection plate 71*a*, a first outer wall 71*b*, a second outer wall 71*c*, a first claw 71*d*, and a second claw 71*e*.

In one or more embodiments, the first member 71 is formed of a sheet metal, which is obtained by rolling, by bending the sheet metal in the longitudinal direction of the gas header 70 although the method of forming the first member 71 is not limited thereto. In this case, the first member 71 has a uniform thickness that is a first thickness.

The flat tube connection plate 71*a* (which is an example of a first portion) has a flat plate shape expanding in the up-and-down direction and in the left-and-right direction. The flat tube connection plate 71*a* has a plurality of flat tube connection openings 71*x* (each of which is an example of a first opening) arranged in the up-and-down direction. Each of the flat tube connection openings 71*x* is bored through the flat tube connection plate 71*a* in the thickness direction. The flat tubes 28 are inserted into the flat tube connection openings 71*x* such that the first ends thereof fully pass through the flat tube connection openings 71*x*, and are joined to the flat tube connection openings 71*x* by brazing. In the state in which the flat tubes 28 are joined to the flat tube connection openings 71*x* by brazing, the entire inner peripheral face of each flat tube connection opening 71*x* is in contact with the entire outer peripheral face of the corresponding flat tube 28. The first thickness, which is the thickness of the first member 71 including the flat tube connection plate 71*a* is relatively thin and is, for example, within a range from about 1.0 mm to about 2.0 mm. This configuration therefore reduces a length of the inner peripheral face of each flat tube connection opening 71*x* in the thickness direction. In inserting each flat tube 28 into the corresponding flat tube connection opening 71*x* before joining the flat tube 28 and the flat tube connection opening 71*x* together by brazing, this configuration reduces friction between the inner peripheral face of the flat tube connection opening 71*x* and the outer peripheral face of the flat tube 28, which facilitates the inserting work.

The first outer wall 71*b* (which is an example of a wall surface portion) has a planar shape and extends from a front face of a left end of the flat tube connection plate 71*a* (i.e., the inner side of the outdoor unit 2, the side of the liquid header 40) toward the first gas-refrigerant pipe 19 along the first inner wall 72*b* (to be described later).

The second outer wall 71*c* (which is an example of a wall surface portion) has a planar shape and extends from a front face of a right end of the flat tube connection plate 71*a* (i.e., the outer side of the outdoor unit 2, the side opposite to the liquid header 40) toward the first gas-refrigerant pipe 19 along the second inner wall 72*c* (to be described later).

The first claw 71*d* (which is an example of a claw) protrudes rightward from a front end of the first outer wall 71*b*. The second claw 71*e* (which is an example of a claw) protrudes leftward from a front end of the second outer wall 71*c*.

In a state before the second member 72, the third member 73, and the fourth member 74 are placed inside the first member 71 as seen in plan view, the first claw 71*d* extends on the extension of the first outer wall 71*b*, and the second claw 71*e* extends on the extension of the second outer wall 71*c*. In the state in which the second member 72, the third member 73, and the fourth member 74 are placed inside the first member 71 as seen in plan view, the first claw 71*d* and the second claw 71*e* are bent to come close to each other. As a result, the second member 72, the third member 73, and the fourth member 74 are fixed together by crimping with the first member 71. In this state, the first member 71, the second member 72, the third member 73, and the fourth member 74 are joined together by brazing in, for example, a furnace and are thus completely fixed together.

(4-2) Third Member

The third member 73 has a flat plate shape expanding in the up-and-down direction and the left-and-right direction. The third member 73 is stacked on the flat tube connection plate 71*a* of the first member 71 in contact with a surface of the flat tube connection plate 71*a* to which the first gas-refrigerant pipe 19 is connected. The third member 73 is similar in left-to-right length to the flat tube connection plate 71*a* of the first member 71 excluding two ends of the flat tube connection plate 71*a*.

Preferably, the third member 73 has on its surface a cladding layer containing a brazing material.

The third member 73 includes an internal plate 73*a* and a plurality of internal openings 73*x*.

The internal plate 73*a* has a flat plate shape expanding in the up-and-down direction and the left-and-right direction.

The internal openings 73*x* are arranged in the up-and-down direction and are bored through the internal plate 73*a* in the thickness direction.

The internal openings 73*x* in the third member 73 each are larger than the flat tube connection openings 71*x* in the flat tube connection plate 71*a* of the first member 71. In the state in which the third member 73 is stacked on the flat tube connection plate 71*a* of the first member 71, an outer edge of each internal opening 73*x* in the third member 73 is located outward of an outer edge of the corresponding flat tube connection opening 71*x* in the flat tube connection plate 71*a* of the first member 71 in the stacking direction of the members, more specifically in the front-and-rear direction. This configuration suppresses occurrence of a situation in which the brazing material moves by a capillary phenomenon in joining the members together by brazing to close the refrigerant passages 28*b* in the flat tubes 28. From this point of view, upper and lower portions of the outer edge of each internal opening 73*x* in the third member 73 may be separated from upper and lower portions of the outer edge of the corresponding flat tube connection opening 71*x* in the flat tube connection plate 71*a* by 2 mm or more, preferably 3 mm or more.

(4-3) Second Member

The second member 72 is disposed between the flat tube connection plate 71*a* of the first member 71 and the main gas-refrigerant pipe connection portion 19*a* in the front-and-rear direction. The second member 72 has a substantially "U" shape as seen in plan view.

The gas-side internal space 25 described above is defined inside the second member 72, more specifically in the space surrounded by the second member 72, the third member 73, and the ends of the flat tubes 28.

Preferably, the second member 72 has a maximum thickness larger than the thickness of the first member 71. This configuration enables pressure resistance strength enhancement to the gas header 70.

Preferably, the second member 72 is obtained by extrusion molding in which the longitudinal direction of the gas header 70 is defined as an extruding direction. However, the method of forming the second member 72 is not limited thereto. The extrusion molding facilitates formation of portions that are different in thickness from one another. A thick sheet metal is relatively expensive. Therefore, cost reduction is achieved in such a manner that a thick second member 72 is formed by extrusion molding. The second member 72 formed by extrusion molding may have no cladding layer containing a brazing material.

The second member 72 includes a first inner wall 72*b*, a second inner wall 72*c*, a coupling portion 72*a*, a first protrusion 72*d*, a second protrusion 72*e*, a first edge 72*f*, and a second edge 72*g*.

The coupling portion 72*a* opposites to a main gas-refrigerant pipe connection portion 19*a*-side surface of the third member 73. The coupling portion 72*a* has a plate shape expanding in the up-and-down direction and the left-and-right direction. The coupling portion 72*a* is located on the side of the main gas-refrigerant pipe connection portion 19*a* in the gas header 70. The coupling portion 72*a* has an internal gas pipe connection opening 72*x* to which the end of the main gas-refrigerant pipe connection portion 19*a* is connected. The internal gas pipe connection opening 72*x* is bored through the coupling portion 72*a* in the thickness direction. The coupling portion 72*a* has an opening (not illustrated) to which the end of the branch gas-refrigerant pipe connection portion 19*b* is connected. This opening is bored through the coupling portion 72*a* in the thickness direction.

The first inner wall 72*b* (which is an example of a first wall) has a planar shape extending from the left end of the coupling portion 72*a* (i.e., the inner side of the outdoor unit 2, the side closer to the liquid header 40) toward the rear side from which the flat tubes 28 protrude. The first inner wall 72*b* has a left face that is in surface contact with a right face of the first outer wall 71*b* of the first member 71.

The second inner wall 72*c* (which is an example of a second wall) has a planar shape extending from the right end of the coupling portion 72*a* (i.e., the outer side of the outdoor unit 2, the side opposite to the liquid header 40) toward the rear side from which the flat tubes 28 protrude. The second inner wall 72*c* has a right face that is in surface contact with a left face of the second outer wall 71*c* of the first member 71.

The first inner wall 72*b* opposites to the second inner wall 72*c*. A front end of the first inner wall 72*b* particularly opposites to a front end of the second inner wall 72*c*.

The coupling portion 72*a*, the first inner wall 72*b*, and the second inner wall 72*c* each have a thickness larger than the thickness of the first member 71 which may be 1.5 times or more, preferably twice or more larger than the thickness of the first member 71.

The first inner wall 72*b* and the second inner wall 72*c* each may have a length in the protruding direction of the flat tubes 28 (the front-and-rear direction), 3 times or more, preferably 5 times or more larger than a length of the coupling portion 72*a* in the protruding direction of the flat tubes 28 (the front-and-rear direction). However, these lengths are not limited thereto.

The coupling portion 72*a* couples the first inner wall 72*b* to the second inner wall 72*c*. Specifically, the coupling portion 72*a* couples the front end (the main gas-refrigerant pipe connection portion 19*a*-side end) of the first inner wall 72*b* to the front end (the main gas-refrigerant pipe connection portion 19*a*-side end) of the second inner wall 72*c*. The coupling portion 72*a* extends in the left-and-right direction when the gas header 70 is seen in plan view. The left-and-right direction is an example of a third direction. Preferably, the third direction is orthogonal to both the first direction and the second direction. More preferably, the first direction, the second direction, and the third direction are orthogonal to one another.

The first edge 72*f* is located behind the first inner wall 72*b*. That is, the first edge 72*f* is located closer to the flat tubes 28 than the first inner wall 72*b* is. The first edge 72*f* has a left face that is flush with a left face of the first inner wall 72*b* and is in surface contact with a right face of the first outer wall 71*b* of the first member 71. The first edge 72*f* has a rear end that is in contact with a front face of the third member 73. The first edge 72*f* is smaller in thickness (width in the left-and-right direction) than the first inner wall 72*b*. A contact portion between the first edge 72*f* and the front face of the third member 73 is located leftward of the flat tubes 28 and leftward of left ends of the internal openings 73*x* (each of which is an example of a second opening) in the third member 73.

The second edge 72*g* is located behind the second inner wall 72*c*. That is, the second edge 72*g* is located closer to the flat tubes 28 than the second inner wall 72*c* is. The second edge 72*g* has a right face that is flush with a right face of the second inner wall 72*c* and is in surface contact with a left face of the second outer wall 71*c* of the first member 71. The second edge 72*g* has a rear end that is in contact with the front face of the third member 73. The second edge 72*g* is smaller in thickness (width in the left-and-right direction) than the second inner wall 72*c*. A contact portion between the second edge 72*g* and the front face of the third member 73 is located rightward of the flat tubes 28 and rightward of right ends of the internal openings 73*x* in the third member 73.

As seen in plan view, a length between the first edge 72*f* and the second edge 72*g* is larger than a width of each flat tube 28, larger than a width of each flat tube connection opening 71*x* in the first member 71, and larger than a width of each internal opening 73*x* in the third member 73. The first edge 72*f* and the second edge 72*g* each extend from the upper end to the lower end of the gas header 70.

The first protrusion 72*d* protrudes rightward (toward the second inner wall 72*c*) from the rear end of the first inner wall 72*b*, that is, a portion forward of the first edge 72*f*. The first protrusion 72*d* extends from the upper end to the lower end of the gas header 70. The first protrusion 72*d* has a right end that is located rightward of the left ends of the internal openings 73*x* in the third member 73 and rightward of the left ends of the flat tubes 28. The first protrusion 72*d* is located closer to the flat tubes 28 with respect to a center of the second member 72 in the front-and-rear direction.

The second protrusion 72*e* protrudes leftward (toward the first inner wall 72*b*) from the rear end of the second inner wall 72*c*, that is, a portion forward of the second edge 72*g*. The second protrusion 72*e* extends from the upper end to the lower end of the gas header 70. The second protrusion 72*e* has a left end located leftward of the right ends of the internal openings 73*x* in the third member 73 and leftward of the right ends of the flat tubes 28. The second protrusion 72*e* is located closer to the flat tubes 28 with respect to the center of the second member 72 in the front-and-rear direction.

A minimum distance between the first protrusion 72*d* and the second protrusion 72*e* (a distance between the first protrusion 72*d* and the second protrusion 72*e* in the left-and-right direction) is shorter than a maximum width of each flat tube 28 in section perpendicular to the refrigerant passage 28*b*. With this configuration, when the flat tubes 28 are inserted into the gas header 70, the first protrusion 72*d* and the second protrusion 72*e* define the degree of insertion of each flat tube 28. This configuration therefore suppresses a reduction in size of the gas-side internal space 25 owing to the excessively large degree of insertion of each flat tube 28. With this configuration, moreover, the first protrusion 72*d* and the second protrusion 72*e* bring the positions of the ends of the flat tubes 28 into alignment in the gas header 70.

(4-4) Fourth Member

The fourth member 74 has a flat plate shape expanding in the up-and-down direction and the left-and-right direction. The fourth member 74 is stacked on the second member 72 in contact with a front face of the coupling portion 72*a*. The fourth member 74 is similar in left-to-right length to the third member 73. The fourth member 74 is also similar in left-to-right length to the flat tube connection plate 71*a* of the first member 71 excluding the two ends of the flat tube connection plate 71*a*.

Preferably, the fourth member 74 has on its surface a cladding layer containing a brazing material. The fourth member 74 is a plate-shaped member; therefore, the cladding layer containing the brazing material is formed on the surface of the fourth member 74 with ease. Therefore, for example, as in the case where the second member 72 is formed by extrusion molding, even in a case where the second member 72 has no cladding layer containing a brazing material, the second member 72 is joined to the other members by brazing with the brazing material on the fourth member 74.

The fourth member 74 includes an external plate 74*a* and has an external gas pipe connection opening 74*x*.

The external plate 74*a* has a flat plate shape expanding in the up-and-down direction and the left-and-right direction.

The external gas pipe connection opening 74*x* is bored through the external plate 74*a* in the thickness direction, and the end of the main gas-refrigerant pipe connection portion 19*a* is connected to the external gas pipe connection opening 74*x*.

The external plate 74*a* has in its lower side an opening (not illustrated) to which the end of the branch gas-refrigerant pipe connection portion 19*b* is connected. This opening is bored through the external plate 74*a* in the thickness direction.

The main gas-refrigerant pipe connection portion 19*a* and the branch gas-refrigerant pipe connection portion 19*b* thus communicate with an inner face of the flat tube connection plate 71*a* of the first member 71 via the gas-side internal space 25 defined by the external gas pipe connection opening 74*x*, the internal gas pipe connection opening 72*x*, the first inner wall 72*b*, and the second inner wall 72*c*.

The fourth member 74 has a front face that is crimped in contact with the first claw 71*d* and second claw 71*e* of the first member 71.

(5) Features of One or More Embodiments (5-1)

In the gas header 70 of the outdoor heat exchanger 11 according to one or more embodiments, the first inner wall 72*b* of the second member 72 extends rearward (in the protruding direction of the flat tubes 28) from the left end of the coupling portion 72*a*, and the second inner wall 72*c* of the second member 72 extends rearward from the right end of the coupling portion 72*a*. With this configuration, the gas-side internal space 25 is secured wide without additional members, by simply extending the first inner wall 72*b* and the second inner wall 72*c*. With this configuration, the gas refrigerant passing through the gas-side internal space 25 is less susceptible to pressure loss.

The space in the header can also be widened in such a manner that multiple plate-shaped members each having an opening are stacked on top of each other. This case however results in an increase in parts count. The space in the header can also be secured wide in such a manner that openings are bored by punching or the like in a thick plate-shaped member. This case however makes it difficult to perform punching because of the thick plate-shaped member. In contrast to this, the second member 72 of the gas header 70 according to one or more embodiments is a single member formed by extrusion molding. This configuration therefore reduces a parts count for securing the gas-side internal space 25 wide, without a problem accompanied with the punching or the like.

In one or more embodiments, the first inner wall 72*b* and the second inner wall 72*c* extend in the protruding direction of the flat tubes 28 in order to secure the gas-side internal space 25 wide. However, the first inner wall 72*b* and the second inner wall 72*c* are coupled together by the coupling portion 72*a*, and the coupling portion 72*a*, the first inner wall 72*b*, and the second inner wall 72*c* are integrated. This configuration enables strength enhancement to the second member 72 and enables pressure resistance strength enhancement to the gas header 70.

The coupling portion 72*a* is particularly provided for coupling the front end of the first inner wall 72*b* to the front end of the second inner wall 72*c*. This case secures the gas-side internal space 25 wide with ease as compared with a case where the coupling portion 72*a* couples any portion of the first inner wall 72*b* in the front-and-rear direction, excluding the two ends of the first inner wall 72*b* in the front-and-rear direction, to any portion of the second inner wall 72*c* in the front-and-rear direction, excluding the two ends of the second inner wall 72*c* in the front-and-rear direction.

(5-2)

In a known cylindrical gas header, it has been necessary to deeply insert a flat tube as a flat-shaped heat transfer tube into the gas header in order to cause the entire end of the flat tube to be located inside the cylindrical gas header. Consequently, unnecessary spaces, where a refrigerant is retained, are defined above and below the ends of the flat tube in the cylindrical gas header. The unnecessary spaces may reduce a flow velocity of the refrigerant in the header. This tendency becomes remarkable as a width of the flat tube is larger.

In contrast to this, in the gas header 70 of the outdoor heat exchanger 11 according to one or more embodiments, the flat tube connection plate 71*a* of the first member 71 and the third member 73 each have a plate shape. In addition, the flat tubes 28 are inserted perpendicularly to the flat tube connection plate 71*a* of the first member 71 and the third member 73. The first outer wall 71*b* and the second outer wall 71*c* extend perpendicularly from the left and right ends of the flat tube connection plate 71*a* of the first member 71, respectively. The first inner wall 72*b* and the second inner wall 72*c* of the second member 72 are joined perpendicularly to the left and right ends of the third member 73, respectively.

With this configuration, in the gas header 70 of the outdoor heat exchanger 11 according to one or more embodiments, an unnecessary space, where a refrigerant is retained, is reduced at a position around the end of each flat tube 28. This configuration reduces a pressure loss of the gas refrigerant flowing through the gas header 70, and suppresses a reduction in flow velocity of the refrigerant in the gas header 70.

(5-3)

In the gas header 70 of the outdoor heat exchanger 11 according to one or more embodiments, the first member 71 including the flat tube connection plate 71*a* is relatively thin. In inserting each flat tube 28 into the corresponding flat tube connection opening 71*x* before joining the flat tube 28 and the flat tube connection opening 71*x* together by brazing, this configuration reduces friction between the inner peripheral face of the flat tube connection opening 71*x* and the outer peripheral face of the flat tube 28, which facilitates the inserting work.

Even if the first member 71 including the flat tube connection plate 71*a* is thin, the third member 73 is stacked on the flat tube connection plate 71*a* in the thickness direction. This configuration enables pressure resistance strength enhancement to the portion of the gas header 70 on the side to which the flat tubes 28 are connected.

In addition, the outer edge of each internal opening 73*x* in the third member 73 is located outward of the outer edge of the corresponding flat tube connection opening 71*x* in the flat tube connection plate 71*a* of the first member 71. At the time of brazing, therefore, even if the brazing material between the flat tube connection openings 71*x* in the flat tube connection plate 71*a* and the flat tubes 28 overflows toward the ends of the flat tubes 28, the overflowing brazing material flows into the spaces in the internal openings 73*x* in the third member 73, the spaces being located outside the flat tubes 28. This configuration therefore suppresses occurrence of a situation in which the refrigerant passages 28*b* in the flat tubes 28 are filled with the brazing material.

(5-4)

In the gas header 70 of the outdoor heat exchanger 11 according to one or more embodiments, the minimum distance between the first protrusion 72*d* and the second protrusion 72*e* (a distance between the first protrusion 72*d* and the second protrusion 72*e* in the left-and-right direction) of the second member 72 is shorter than the maximum width of each flat tube 28 in section perpendicular to the refrigerant passage 28*b*. This configuration therefore defines the degree of insertion of each flat tube 28 in the gas header 70.

The first protrusion 72*d* and the second protrusion 72*e* that define the degree of insertion of each flat tube 28 are located closer to the flat tubes 28 with respect to the center of the second member 72 in the front-and-rear direction. This configuration therefore secures the gas-side internal space 25 sufficiently wide.

(6) Modifications (6-1) Modification A

In the foregoing embodiments, with regard to the second member 72 of the gas header 70 of the outdoor heat exchanger 11, the coupling portion 72*a* couples the end of the first inner wall 72*b* to the end of the second inner wall 72*c*.

Figure 15:
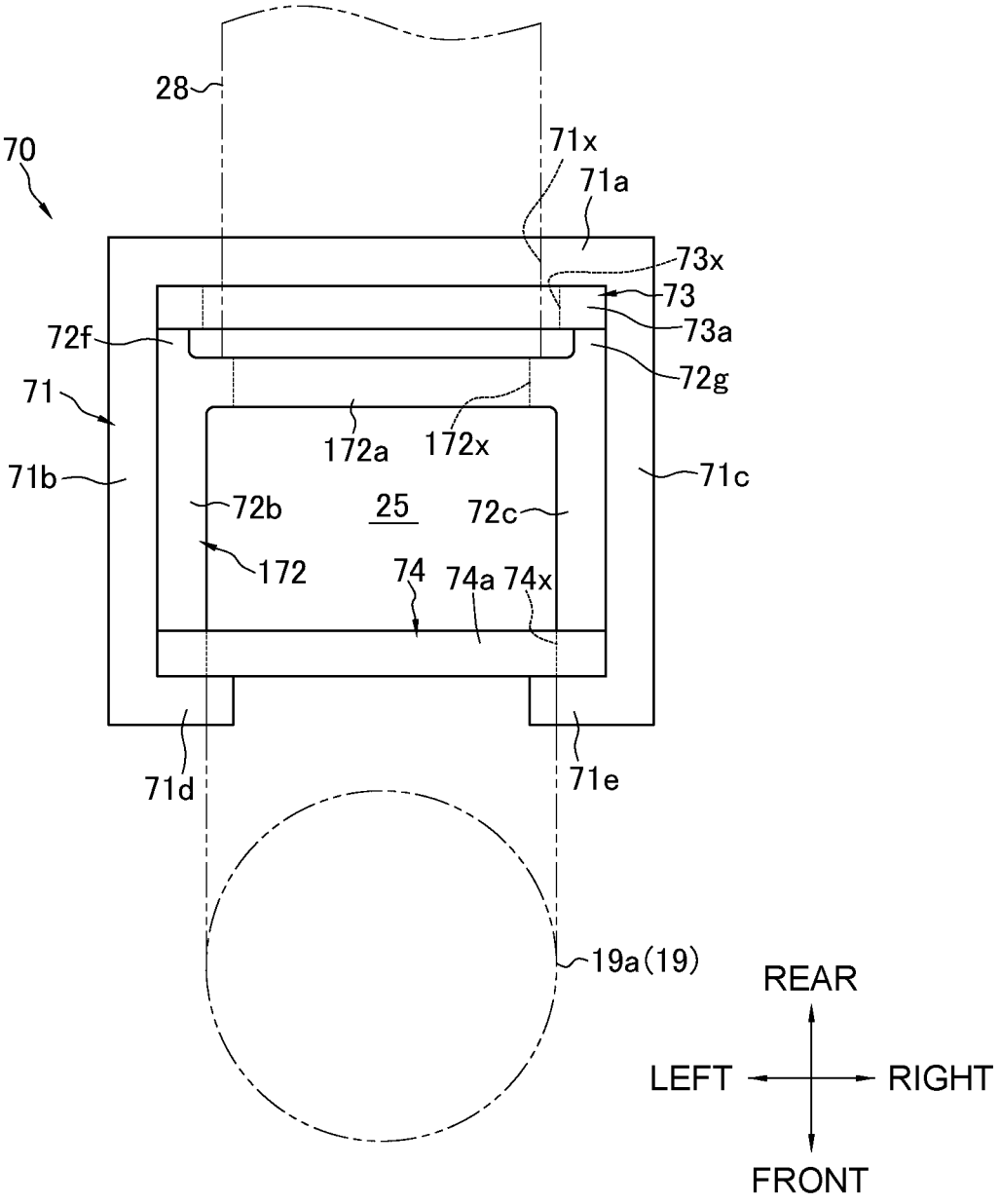
FIG. 15 is a sectional view of a gas header to which a main gas-refrigerant pipe connection portion and a flat tube are connected as seen in plan view in Modification A.
Figure 16:
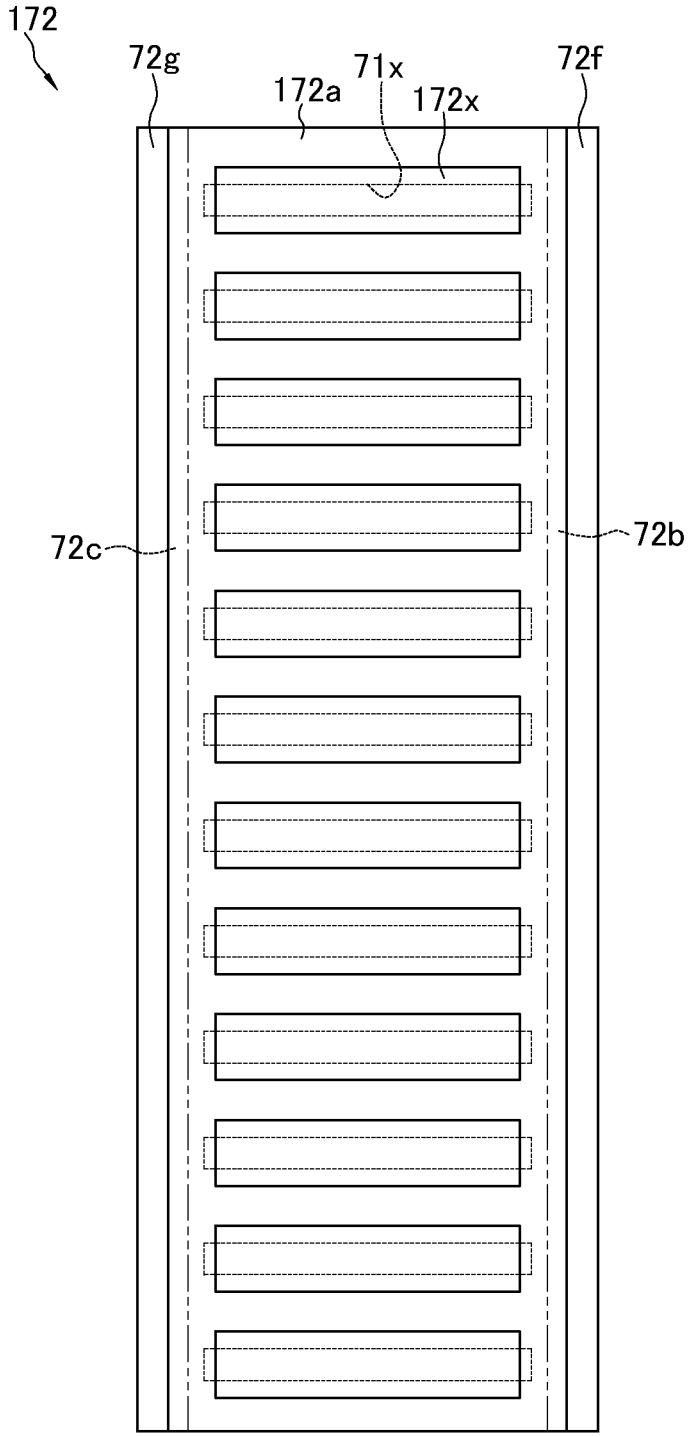
FIG. 16 is a projection view of a positional relationship among openings in a case where a second member is seen from its rear side in Modification A.

In place of this, for example, a second member 172 illustrated in FIGS. 15 and 16 may be used as a second member of the gas header 70 of the outdoor heat exchanger 11. FIG. 15 is a sectional view of the gas header 70 to which the main gas-refrigerant pipe connection portion 19*a* and the flat tubes 28 are connected as seen in plan view. FIG. 16 is a projection view of a positional relationship among openings in a case where the second member 172 is seen from its rear side.

The second member 172 includes a coupling portion 172*a* instead of the coupling portion 72*a* of the second member 72 according to the foregoing embodiments. The coupling portion 172*a* couples a portion between the ends of the first inner wall 72*b* in the front-and-rear direction (the protruding direction of the flat tubes 28) to a portion between the ends of the second inner wall 72*c* in the front-and-rear direction (the protruding direction of the flat tubes 28). As described above, the coupling portion 172*a* couples the first inner wall 72*b* and the second inner wall 72*c* at the portions different from the ends. This configuration therefore enables structural strength enhancement to the second member 172.

The coupling portion 172*a* has a plate shape expanding in the up-and-down direction and the left-and-right direction. The coupling portion 172*a* has a plurality of internal gas pipe connection openings 172*x* arranged in the up-and-down direction. The internal gas pipe connection openings 172*x* are formed corresponding to the respective flat tubes 28. The internal gas pipe connection openings 172*x* are larger in size in the up-and-down direction than the flat tubes 28 and the flat tube connection openings 71*x* in the first member 71. On the other hand, the internal gas pipe connection openings 172*x* are smaller in size in the width direction (the left-and-right direction) than the flat tubes 28 and the flat tube connection openings 71*x* in the first member 71. This configuration thus defines the degree of insertion of each flat tube 28. Since an edge of each internal gas pipe connection opening 172*x* is used for defining the degree of insertion of the corresponding flat tube 28, the second member 72 does not necessarily include the first protrusion 72*d* and the second protrusion 72*e* in the foregoing embodiments.

(6-2) Modification B

In the foregoing embodiments, the gas header 70 includes the third member 73 and the fourth member 74.

Figure 17:
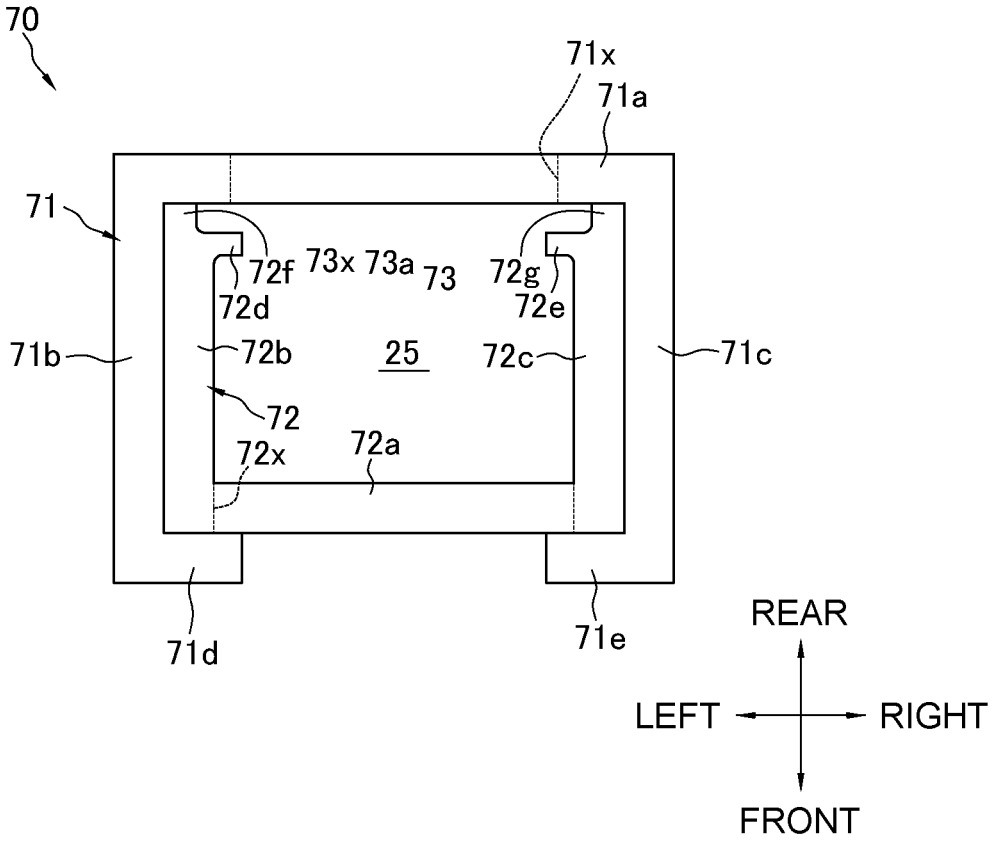
FIG. 17 is a sectional view of a gas header as seen in plan view in Modification B.

In place of this, for example, a gas header 70 illustrated in FIG. 17 may not include one of or both the third member 73 and the fourth member 74 in the foregoing embodiments.

In this case, increasing the thickness of the flat tube connection plate 71*a* of the first member 71 secures pressure resistance strength.

Although the present disclosure has been described with respect to only a limited number of embodiments, those skilled in the art, having benefit of this disclosure, will appreciate that various other embodiments may be devised without departing from the scope of the present disclosure. Accordingly, the scope of the present disclosure should be limited only by the attached claims.

REFERENCE SIGNS LIST

1: air conditioning apparatus
11: outdoor heat exchanger (heat exchanger)
19: first gas-refrigerant pipe (first pipe, gas pipe)
19*a*: main gas-refrigerant pipe connection portion (first pipe, gas pipe)
19*b*: branch gas-refrigerant pipe connection portion (first pipe, gas pipe)
25: gas-side internal space (space defined by first wall and second wall)
28: flat tube (heat transfer tube)
70: gas header (header)
71: first member
71*a*: flat tube connection plate (first portion)
71*b*: first outer wall (wall surface portion)
71*c*: second outer wall (wall surface portion)
71*d*: first claw (claw)
71*e*: second claw (claw)
71*x*: flat tube connection opening (first opening)
72: second member
72*a*: coupling portion
72*b*: first inner wall (first wall)
72*c*: second inner wall (second wall)
72*d*: first protrusion
72*e*: second protrusion
72*x*: internal gas pipe connection opening
73: third member
73*x*: internal opening (second opening)
74: fourth member
74*x*: external gas pipe connection opening
172: second member
172*a*: coupling portion
172*x*: internal gas pipe connection opening

The invention claimed is:

1. A heat exchanger connected to a first pipe through which a refrigerant flows, the heat exchanger comprising:
heat transfer tubes extending in a first direction; and
a header connected to the heat transfer tubes, wherein
the header includes:
a first member including a first portion connected to the heat transfer tubes; and
a second member disposed between the first pipe and the first portion; and
a third member disposed to face a side of the first portion of the first member where the second member is disposed,
the second member includes:
a first wall and a second wall that each extend in the first direction; and
a coupling portion that couples the first wall to the second wall,
the first pipe communicates with each heat transfer tube through a space delimited by the first wall and the second wall,
a longitudinal direction of the first wall and a longitudinal direction of the second wall in a section view along the longitudinal direction of the header are in the first direction,
the first wall, the second wall, and the coupling portion are plates,
the coupling portion, the first wall, and the second wall each have a thickness greater than a thickness of the first member,
the first portion has first openings that accommodate the heat transfer tubes,
the third member has second openings that accommodate the heat transfer tubes, and
each first opening has a portion overlapping the respective second opening when viewed in the first direction.

2. The heat exchanger according to claim 1, wherein
the coupling portion couples an end of the first wall in the first direction to an end of the second wall in the first direction.

3. The heat exchanger according to claim 1, wherein
the coupling portion couples a portion of the first wall to a portion of the second wall,
the portion of the first wall is different from two ends of the first wall in the first direction, and
the portion of the second wall is different from two ends of the second wall in the first direction.

4. The heat exchanger according to claim 1, wherein the first portion is planar.

5. The heat exchanger according to claim 1, wherein the second member includes:

a first protrusion protruding from the first wall toward the second wall; and a second protrusion protruding from the second wall toward the first wall, the first and second protrusions are disposed closer to the heat transfer tubes than the coupling portion, and a minimum distance between the first protrusion and the second protrusion is shorter than a maximum width of each heat transfer tube in a section view perpendicular to the heat transfer tubes.

6. The heat exchanger according to claim 5, wherein the coupling portion couples a portion of the first wall to a portion of the second wall, the portion of the first wall is disposed closer to the first pipe than a center of the first wall in the first direction, the portion of the second wall is disposed closer to the first pipe than a center of the second wall in the first direction, the first protrusion is disposed closer to the heat transfer tubes than the center of the first wall in the first direction, and the second protrusion is disposed closer to the heat transfer tubes than the center of the second wall in the first direction.

7. The heat exchanger according to claim 5, wherein the first wall includes a first edge disposed on a side of the first protrusion disposed closer to the heat transfer tubes than the coupling portion, the second wall includes a second edge disposed on a side of the second protrusion disposed closer to the heat transfer tubes than the coupling portion, a thickness of the first edge is less than a thickness of the first wall disposed between the first protrusion and the coupling portion, and a thickness of the second edge is less than a thickness of the second wall disposed between the second protrusion and the coupling portion.

8. The heat exchanger according to claim 7, wherein a minimum distance between the first edge and the second edge is larger than the maximum width of each heat transfer tube in a section view perpendicular to the heat transfer tubes.

9. The heat exchanger according to claim 1, wherein each second opening is larger than the corresponding first opening when viewed in the first direction, and an edge of each second opening is located outward of an edge of the corresponding first opening when viewed in the first direction.

10. The heat exchanger according to claim 1, further comprising:

an external plate connected to the first pipe, wherein the first member includes:

wall surface portions that respectively extend from two ends of the first portion toward the first pipe along the first wall and the second wall, respectively; and claws respectively disposed on ends of the wall surface portions opposite to the first portion, the claws extend toward each other, and the claws are in contact with a surface of the external plate that opposes the first portion.

11. The heat exchanger according to claim 1, wherein each heat transfer tube is a flat tube with a flat face.

12. The heat exchanger according to claim 1, wherein the first pipe is a gas pipe.

13. A heat pump apparatus comprising:

the heat exchanger according to claim 1.

14. The heat exchanger according to claim 1, wherein the first member has a first wall portion and a second wall portion, the first wall portion extends in the first direction from one end of the first portion along the outside of the first wall, and the second wall portion extends in the first direction from the other end of the first portion along the outside of the second wall.

15. A heat exchanger connected to a first pipe through which a refrigerant flows, the heat exchanger comprising:

heat transfer tubes extending in a first direction; and a header connected to the heat transfer tubes, wherein the header includes:

a first member including a first portion connected to the heat transfer tubes; and a second member disposed between the first pipe and the first portion, the second member includes:

a first wall and a second wall that each extend in the first direction;

a coupling portion that couples the first wall to the second wall;

a first protrusion protruding from the first wall toward the second wall; and a second protrusion protruding from the second wall toward the first wall, the first pipe communicates with each heat transfer tube through a space delimited by the first wall and the second wall, a longitudinal direction of the first wall and a longitudinal direction of the second wall in a section view along the longitudinal direction of the header are in the first direction, the first wall, the second wall, and the coupling portion are plates, the first and second protrusions are disposed closer to the heat transfer tubes than the coupling portion, a minimum distance between the first protrusion and the second protrusion is shorter than a maximum width of each heat transfer tube in a section view perpendicular to the heat transfer tubes, the first wall includes a first edge disposed on a side of the first protrusion disposed closer to the heat transfer tubes than the coupling portion, the second wall includes a second edge disposed on a side of the second protrusion disposed closer to the heat transfer tubes than the coupling portion, a thickness of the first edge is less than a thickness of the first wall disposed between the first protrusion and the coupling portion, and a thickness of the second edge is less than a thickness of the second wall disposed between the second protrusion and the coupling portion.

* * * * *